US011623325B2

(12) United States Patent
Keiser et al.

(10) Patent No.: US 11,623,325 B2
(45) Date of Patent: Apr. 11, 2023

(54) ROTARY BRUSH

(71) Applicant: Osborn, LLC, Richmond, IN (US)

(72) Inventors: Brian Keiser, Cambridge City, IN (US); Brad Vanwinkle, Richmond, IN (US); Zachary Baumgardner, Lynn, IN (US); Zachary Small, Richmond, IN (US); Shane Clifford, Glenwood, IN (US)

(73) Assignee: OSBORN, LLC, Richmond, IN (US)

( * ) Notice: Subject to any disclaimer, the term of this patent is extended or adjusted under 35 U.S.C. 154(b) by 758 days.

(21) Appl. No.: 16/477,064

(22) PCT Filed: Jun. 5, 2018

(86) PCT No.: PCT/US2018/036166
§ 371 (c)(1),
(2) Date: Oct. 30, 2019

(87) PCT Pub. No.: WO2018/226768
PCT Pub. Date: Dec. 13, 2018

(65) Prior Publication Data

US 2020/0198097 A1 Jun. 25, 2020

Related U.S. Application Data

(60) Provisional application No. 62/515,122, filed on Jun. 5, 2017.

(51) Int. Cl.
*B24D 13/10* (2006.01)

(52) U.S. Cl.
CPC ..... *B24D 13/10* (2013.01)

(58) Field of Classification Search
CPC ..... B24D 13/10; B24B 29/005; A46B 7/06; A46B 7/08; A46B 7/10
See application file for complete search history.

(56) References Cited

U.S. PATENT DOCUMENTS 2,866,989 A 1/1959 Peterson et al.
5,207,032 A 5/1993 Frymier
(Continued)

FOREIGN PATENT DOCUMENTS

EP 0666143 8/1995
EP 1356748 A1 * 10/2003 ..... A46B 13/008
(Continued)

OTHER PUBLICATIONS

Extended European Search Report—dated Feb. 5, 2021.
European Patent Office, Extended European Search Report, EU Patent App. No 19882549.9, dated Sep. 27, 2022.

*Primary Examiner* — Joel D Crandall
(74) *Attorney, Agent, or Firm* — McDonald Hopkins LLC

(57) ABSTRACT

A rotary radial wire brush made of an annular center disc hub having 32 holes circumferentially spaced apart two radially offset distances from a center about which the brush rotates with a brush wire formed of between 22 and 34 filaments or bristles providing increased material removal rates during a longer useful operating life. A preferred brush has a hub with radially outermost openings larger in size than radially innermost openings causing the brush wire anchored by its twist knot thereto to be more flexible and extend farther radially outwardly than a shorter stiffer more aggressive wire produced by anchoring via a longer twist knot to radially innermost openings. Such a construction produces a rotary brush of the invention with brush wires of alternating flexible and aggressive construction increasing surface finish and material removal rates while having increased brush life.

24 Claims, 14 Drawing Sheets

(56) References Cited

U.S. PATENT DOCUMENTS

| | | | | |
|---|---|---|---|---|
| 5,406,669 | A * | 4/1995 | Lesiw | B24D 13/10 15/198 |
| 5,926,904 | A | 7/1999 | Warner | |
| 6,035,482 | A | 3/2000 | Belanger et al. | |
| 6,217,431 | B1 * | 4/2001 | Brinkmann | B24D 13/06 451/469 |
| 2002/0132572 | A1 | 9/2002 | Lageson | |
| 2011/0092144 | A1 | 4/2011 | Woods et al. | |
| 2017/0304997 | A1 | 10/2017 | Akashi et al. | |

FOREIGN PATENT DOCUMENTS

| | | | |
|---|---|---|---|
| GB | 6322793 | | 12/1949 |
| JP | S61241071 | | 10/1986 |
| JP | 1989033311 | | 7/1989 |
| JP | 07-028433 | | 5/1995 |
| JP | H07266241 | | 10/1995 |
| JP | H08317608 | | 11/1996 |
| JP | 2008206798 | | 9/2008 |
| JP | 2008206798 | A * | 9/2008 |
| JP | 2007062003 | | 10/2008 |
| JP | 2013141731 | | 7/2013 |
| KR | 10-0289514 | | 5/2001 |
| KR | 101605525 | | 3/2016 |

* cited by examiner

ROTARY BRUSH

CROSS REFERENCE

This application claims priority under 35 U.S.C. § 119(e) in U.S. Provisional Patent Application No. 62/515,122 filed Jun. 5, 2017, the entire disclosure of which is hereby expressly incorporated herein by reference.

FIELD

The present invention is directed to rotary brushes used in abrasive material removal applications, and more specifically to radial brushes and cup brushes of improved construction.

BACKGROUND

There are many different types and sizes of rotary wire brushes used in many different types of abrasive material removal and surface finishing applications. One type of rotary brush is a wheel wire brush that is removably attached to a powered rotary tool, such as a grinder, e.g., angle grinder, straight grinder, die grinder or bench grinder, a hand drill, or even a drill press, which typically is used in more demanding abrasive material removal and surface finishing applications. Examples of some applications well suited for wheel brush use include: surface finishing to improve surface finish without altering product dimensions, edge blending to smooth, round or blend corners, cleaning in wet or dry applications to remove surface matter and particles, roughening to rough surfaces prior to bonding or painting to improve adhesion, removing flash, removing rust, removing paint, deburring, de-flashing, cleaning weld beads, part finishing, sharpening, edge radiusing, edge blending, skiving, cleaning, polishing, and buffing.

While there are a multitude of different wheel brushes presently available, whose choice is dependent on the type of abrasive material removal or surface finishing application, wheel brushes come in two main types: crimped wire wheel brushes and knotted wire wheel brushes. Crimped wire wheel brushes are formed of elongate wavy wire filaments which are captured by teeth or holes of a retaining ring around which an annular channel or pair of cover plates or face plates are tightly crimped. The crimped wavy filaments of crimped wire wheel brushes are evenly distributed about the circumference of the brush making them suited for less demanding abrasive material removal and surface finishing applications, such as decorative finishing, paint removal, light duty surface cleaning, and polishing, where more uniform material removal or a higher level of surface finishing is desired.

Knotted wire wheel brushes are a type of power brush which employ elongate wires made of multiple brush wire filaments each having a relatively large or larger wire filament diameter that enables such wheel brushes to be used in more demanding abrasive material removal or surface finishing applications requiring a greater rate of material removal or the ability to more aggressively treat surfaces. Such wheel brushes can have wires made of many different types of filaments, such as filaments made of Tampico, nylon, or polypropylene, nonferrous filaments, such as filaments made of brass or bronze, e.g., phosphorous bronze, ferrous filaments such as a medium or high-carbon steel, e.g., heat-treated, high tensile strength high-carbon or high drawn steel wire filaments, and stainless steel, e.g., Type 302 stainless steel, Type 304 stainless steel or Type 316 stainless steel, and coated or encapsulated filaments, such as elastomer or plastic coated metallic wire filaments, whose choice typically depends on the abrasive material removal or surface finishing application.

Such wire wheel brushes also employ different types of knots to anchor wires formed of multiple filaments to a central disc or hub of the brush about the periphery of the brush. In a standard knot wire wheel brush, each brush wire is formed of a bundle of straight wire filaments attached by a twisted knot to an apertured circular hub of the brush anchoring the wire thereto with the filaments of the wire twisted about two-thirds the length of the wire in a manner that produces a tuft that is outwardly flared at the head or abrasive face of the wire. Such a standard knot wire wheel brush has an outwardly flared tufted head that provides a larger abrasive material removal footprint with increased flexibility at the abrasively contacting wire face. Such standard knot wire wheels are commonly used to deflash and clean motor mounts, clean foundry molds, perform weld preparation and post-weld cleaning, remove heavy surface contamination, clean piping and pipelines, and for heavy duty deburring. A variation of a standard knot wire wheel brush is hurricane twist knot wire wheel brush with wires twisted less tightly producing a more flexible wire having an even wider tuft and face that provides smoother but less aggressive abrasive material removal operation.

In a cable knot wire wheel brush, each brush wire also is formed of a bundle of straight wire filaments attached by a twisted knot to an apertured circular hub of the brush anchoring the wire thereto with the filaments of the wire twisted along the entire length of the wire that provides smaller wire tuft. Such a cable knot wire wheel brush has the filaments of the wire twisted the full length producing a less flexible narrow tuft wire having a smaller and tighter head and face such that the wire filament tips of the abrasive wire face provides more aggressive abrasive material removal and surface finishing. Such cable knot wire wheels are commonly used to drawing welding wire, for stripping carbon deposits, scale and rust including from such welding wire.

In a stringer bead knot wire wheel brush, each brush wire also is formed of a bundle of straight wire filaments attached by an apertured circular hub of the brush anchoring the wire thereto with the filaments of the wire twisted even more tightly the entire length of the wire in a manner that produces an even more tightly wound stiffer tuft with an even narrower face than cable knot twisted wires. Such a stringer bead knot wire wheel brush has tightly wound twisted tufted head that provides a narrower abrasive material removal footprint with less flexibility at the abrasively contacting wire face. Such stringer bead knot wire wheels are commonly used to abrasively remove material from small channels and grooves and for preparing pipe prior to welding.

In the past, rotary brushes have continued to evolve towards the ever-elusive goal of optimizing material removal as a function of brush wear to obtain the goldilocks of rotary brushes that removes enough material during use to be effective in even the most demanding surface finishing applications while being long lasting enough to do so over a long working life. While many attempts have been made to date to produce such a rotary brush and many claims have been made to date to produce such a rotary brush, it is believed that all of these attempts and claims have heretofore produced rotary brushes falling short in one or more areas leading to less than optimal performance.

This is because tradeoffs or compromises were made in such prior art brushes and brush designs resulting in brushes that removed a greater amount or volume of material per minute of brushing or surface finishing operation typically required brush wires made of harder, more abrasive, and stiffer filament materials that possessed greater wear rates thereby producing a brush having a shorter useful operating life. Conversely, long-lived prior art brushes achieved longer operating lives by employing more flexible brush wires that tend made of less abrasive filament materials that tended to be less brittle that lasted longer at the expense of removing significantly less material per minute of brushing or surface finishing operation.

What is therefore needed is a rotary brush having a construction or configuration having both increased material removal rates and a longer useful operating life.

INVENTION SUMMARY

The present invention is directed to a rotary brush, more specifically a rotary radial brush, preferably a wire wheel brush, and more preferably a power brush, having longer brush life and increased material removal rates thereby producing a rotary brush of the present invention that optimizes both parameters preferably without compromising virtually any other aspect of brush life, operation, reliability, or performance.

While prior art radial brushes have been made with a central disc hub having (a) a 32 hole center-slot patterns, where the holes or slots are aligned circumferentially by being spaced the same radial distance from the center of the disc hub, and (b) a 30 hole offset-hole pattern having (i) one set of the holes aligned circumferentially and spaced a first radial distance from the center of the disc hub, and (ii) another set of the holes aligned circumferentially and spaced a second radial distance from the center of the disc hub radially outwardly offset from the first radial distance, it is believed that a radial brush having a central disc hub with a 32 hole offset-hole pattern has heretofore never been employed. As such, at least one preferred radial brush embodiment shown and disclosed herein has a 32-hole offset-hole pattern constructed in accordance with the present invention that unexpectedly achieved improved performance and extended life, producing a 32-hole offset-hole pattern radial brush of the present invention that removes a higher rate of material during surface finishing use for a longer period of time before requiring replacement. Such a preferred 32-hole offset-hole pattern radial brush constructed in accordance with the present invention unexpectedly and advantageously possesses an optimal combination of a higher rate of material removal and longer or extended radial brush life believed not heretofore seen in the prior art.

In addition, it also is believed that such a rotary radial brush made with a center disc hub of 32-hole offset hole configuration having an elongate brush wire extending radially from each one of the 32 holes where each wire is formed of at least 22 wire filaments per hole and preferably no more than about 34 wire filaments per hole also has heretofore never been employed. Such a rotary radial brush having a 32-hole offset hub with between 22 and 34 filaments per wire per hole advantageously possesses outstanding brush life and very good to excellent material removal characteristics producing a rotary radial brush of the present invention that preferably is a wire wheel brush of optimized construction in accordance with the present invention.

In one preferred embodiment, a 32-hole offset hole configuration rotary radial brush constructed in accordance with the present invention employs brush wires each formed of at least 22 brush wire filaments braided substantially along the length of each wire further improving brush life and/or abrasive material removal performance. In one such preferred embodiment, each one of the brush wires is formed of no more than 34 wire filaments and preferably no more than about 32 wire filaments. Such brush wire filaments can be made or otherwise composed of Tampico, nylon, or polypropylene, nonferrous filaments, such as filaments made of brass or bronze, e.g., phosphorous bronze, ferrous filaments such as a medium or high-carbon steel, e.g., heat-treated, high tensile strength high-carbon or high drawn steel wire filaments, and stainless steel, e.g., Type 302 stainless steel, Type 304 stainless steel or Type 316 stainless steel, and coated or encapsulated filaments, such as elastomer or plastic coated metallic wire filaments.

If desired, each one of the brush wire filaments in turn can be formed of at least a plurality of thinner or narrower filament strands braided, twisted or otherwise woven together. In a preferred embodiment, each one of the brush wire filaments is formed of at least a plurality of pairs, i.e., at least three, of strands that are braided, twisted or otherwise woven together. In one such preferred embodiment, a 32-hole offset hole configuration rotary radial brush of the present invention has a brush wire extending radially outwardly from each hole that is of braided construction having between 22 and 34, preferably between 22 and 32, wire filaments braided substantially the length of each brush wire. In a preferred embodiment, each brush wire filament is formed of at least a plurality, preferably at least a plurality of pairs, of filament strands braided together substantially the length of the filament. In another preferred embodiment, each brush wire filament is formed of at least a plurality, preferably at least a plurality of pairs, of filament strands twisted together substantially the length of the filament. In still another preferred embodiment, each brush wire filament is formed of at least a plurality of, preferably at least a plurality of pairs, filament strands that are both braided and twisted together substantially the length of the filament. Brush wire filament strands are each smaller in width or diameter than brush wire filaments. Where each brush wire is formed of filaments which are in turn composed of multiple strands, such strands can be made or otherwise composed of Tampico, nylon, or polypropylene, nonferrous filament strands, such as filament strands made of brass or bronze, e.g., phosphorous bronze, ferrous filament strands such as a medium or high-carbon steel, e.g., heat-treated, high tensile strength high-carbon or high drawn steel wire filament strands, and stainless steel, e.g., Type 302 stainless steel, Type 304 stainless steel or Type 316 stainless steel, and coated or encapsulated filament strands, such as elastomer or plastic coated metallic wire filament strands.

In another preferred embodiment, a 32-hole offset hole configuration rotary radial brush constructed in accordance with the present invention employs brush wires each formed of at least 22 brush wire filaments twisted substantially along the length of each wire further improving brush life and/or abrasive material removal performance. In one such preferred embodiment, each one of the brush wires is formed of no more than 34 wire filaments and preferably no more than about 32 wire filaments. Such brush wire filaments can be made or otherwise composed of Tampico, nylon, or polypropylene, nonferrous filaments, such as filaments made of brass or bronze, e.g., phosphorous bronze, ferrous filaments such as a medium or high-carbon steel, e.g., heat-treated, high tensile strength high-carbon or high drawn steel wire filaments, and stainless steel, e.g., Type 302 stainless steel, Type 304 stainless steel or Type 316 stainless steel, and coated or encapsulated filaments, such as elastomer or plastic coated metallic wire filaments.

If desired, each one of the brush wire filaments in turn can be formed of at least a plurality of filament strands braided, twisted or otherwise woven together. In a preferred embodiment, each one of the brush wire filaments is formed of at least a plurality of pairs, i.e., at least three, of strands that are braided, twisted or otherwise woven together. In one such preferred embodiment, a 32-hole offset hole configuration rotary radial brush of the present invention has a brush wire extending radially outwardly from each hole that is of twisted wire construction having between 22 and 34, preferably between 22 and 32, wire filaments twisted together substantially the length of each brush wire. In a preferred embodiment, each brush wire filament is formed of at least a plurality, preferably at least a plurality of pairs, of filament strands twisted together substantially the length of the filament. In another preferred embodiment, each brush wire filament is formed of at least a plurality, preferably at least a plurality of pairs, of filament strands braided together substantially the length of the filament. In still another embodiment, each brush wire filament is formed of at least a plurality, preferably at least a plurality of pairs, of filament strands both braided and twisted together substantially the length of the filament. Where each brush wire is formed of filaments which are in turn composed of multiple strands, such strands can be made or otherwise composed of Tampico, nylon, or polypropylene, nonferrous filament strands, such as filament strands made of brass or bronze, e.g., phosphorous bronze, ferrous filament strands such as a medium or high-carbon steel, e.g., heat-treated, high tensile strength high-carbon or high drawn steel wire filament strands, and stainless steel, e.g., Type 302 stainless steel, Type 304 stainless steel or Type 316 stainless steel, and coated or encapsulated filament strands, such as elastomer or plastic coated metallic wire filament strands.

In a further preferred embodiment, a 32-hole offset hole configuration rotary radial brush constructed in accordance with the present invention employs brush wires each formed of at least 22 brush wire filaments that are both twisted and braided substantially along the length of each wire further improving brush life and/or abrasive material removal performance. In one such preferred embodiment, each one of the brush wires is formed of no more than 34 wire filaments and preferably no more than about 32 wire filaments. Such brush wire filaments can be made or otherwise composed of Tampico, nylon, or polypropylene, nonferrous filaments, such as filaments made of brass or bronze, e.g., phosphorous bronze, ferrous filaments such as a medium or high-carbon steel, e.g., heat-treated, high tensile strength high-carbon or high drawn steel wire filaments, and stainless steel, e.g., Type 302 stainless steel, Type 304 stainless steel or Type 316 stainless steel, and coated or encapsulated filaments, such as elastomer or plastic coated metallic wire filaments.

If desired, each one of the brush wire filaments in turn can be formed of at least a plurality of filament strands braided, twisted or otherwise woven together to form the filament. In a preferred embodiment, each one of the brush wire filaments is formed of at least a plurality of pairs, i.e., at least three, of strands that are braided, twisted or otherwise woven together. In one such preferred embodiment, a 32-hole offset hole configuration rotary radial brush of the present invention has a brush wire extending radially outwardly from each hole that is of twisted and braided wire construction having between 22 and 34, preferably between 22 and 32, wire filaments twisted and braided together substantially the length of each brush wire. In a preferred embodiment, each brush wire filament is formed of at least a plurality, preferably at least a plurality of pairs, of filament strands twisted together substantially the length of the filament. In another preferred embodiment, each brush wire filament is formed of at least a plurality, preferably at least a plurality of pairs, of filament strands braided together substantially the length of the filament. In still another embodiment, each brush wire filament is formed of at least a plurality, preferably at least a plurality of pairs, of filament strands both braided and twisted together substantially the length of the filament. Where each brush wire is formed of filaments which are in turn composed of multiple strands, such strands can be made or otherwise composed of Tampico, nylon, or polypropylene, nonferrous filament strands, such as filament strands made of brass or bronze, e.g., phosphorous bronze, ferrous filament strands such as a medium or high-carbon steel, e.g., heat-treated, high tensile strength high-carbon or high drawn steel wire filament strands, and stainless steel, e.g., Type 302 stainless steel, Type 304 stainless steel or Type 316 stainless steel, and coated or encapsulated filament strands, such as elastomer or plastic coated metallic wire filament strands.

Each wire is anchored in its respective hole to the center disc hub by a twisted knot where the wire preferably is relatively tightly twisted and/or braided along substantially the entire length of the wire having a relatively narrow tuft and working face at or adjacent the free or working end of the wire. In a preferred embodiment, each wire is anchored to the center disc hub by a twisted knot that is relatively tightly twisted and preferably tightly twisted enough to produce a free end or working end of the wire with a tuft and face that is substantially the same as the width or diameter of the brush wire filaments that make up the brush wire. Having such a tightly twisted knot that produces such a narrow tuft with such a relatively small working face at the free end or working end of each brush wire is critical to producing a rotary brush in accordance with the present invention having such high material removal rates and such an extended brush wire life. The use of such a tightly twisted knot produces a brush of the present invention with brush wires each made of multiple filaments twisted and/or braided together tightly enough to produce a tuft width or diameter and/or a working face width and/or diameter substantially the same as that of the brush wire filaments in a straightened and parallel condition where the filaments adjoin one another along their lengthwise sides or outer surfaces.

In one preferred embodiment, each wire is anchored to the center disc hub by a twisted knot that preferably is a cable knot of relatively tight twist where the filaments that make up each wire are twisted and/or braided substantially along the entire length of the wire to produce such a desirably small or narrow tuft and such a desirable small working face. In one such preferred embodiment, the wire filaments that make up each wire are both braided and twisted with each wire attached to the center disc hub by such a cable knot. The use of such a cable knot produces a brush wire of the present invention made of multiple filaments twisted and/or braided together tightly enough to produce a tuft width or diameter and/or a working face width and/or diameter substantially the same as that of the brush wire filaments in a straightened and parallel condition where the filaments adjoin one another along their lengthwise sides or outer surfaces.

In another such preferred embodiment, each wire is anchored to the center disc hub by a twisted knot that preferably is a stringer bead knot where the filaments that make up each wire are tightly twisted substantially along the entire length of the wire to produce such a desirably small or narrow tuft and such a desirable small working face. In one such preferred embodiment, the wire filaments that make up each wire are both braided and twisted with each wire attached to the center disc hub by such a stringer bead knot. The use of such a stringer knot produces a brush with brush wires of the present invention made of multiple filaments twisted and/or braided together tightly enough to produce a tuft width or diameter and/or a working face width and/or diameter substantially the same as that of the brush wire filaments in a straightened and parallel condition where the filaments adjoin one another along their lengthwise sides or outer surfaces.

A rotary radial brush constructed in accordance with the present invention is composed of the 32-hole offset hole center disc hub each having a brush wire extending radially outwardly from each hole with the hub coupled to or carrying at least one outer cover plate and preferably sandwiched between a pair of outer cover plates. In one preferred embodiment of a radial brush of the present invention, each one of the outer cover plates of the brush are three-dimensionally contoured in a manner that strengthens the brush of the invention preferably by stiffening and/or structurally rigidifying the brush.

In one preferred embodiment, each cover plate has at least a plurality of pairs, i.e., at least three, radially extending ribs formed therein that strengthen at least the cover plate and which preferably strengthen the entire assembly of the cover plates and the center hub thereby advantageously strengthening the entire brush. In one such preferred embodiment, each cover plate has at least four ribs equiangularly spaced apart that each extend from at or adjacent a mount disposed at or adjacent a center of the plate radially outwardly to or adjacent an outer peripheral edge of the plate. Another such preferred embodiment has four such equiangularly spaced apart radial ribs integrally formed in or of each cover plate of the brush. In at least one embodiment, each radial rib formed in or of part of one or both cover plates are upraised ribs that extend axially outwardly away from the center disc hub sandwiched between the plates.

In another preferred embodiment, at least one and preferably both cover plates of the brush have at least one circumferentially extending upraised ridge disposed between the mount and outer peripheral edge of each plate. In one such preferred embodiment, each plate has a single circumferentially extending upraised ridge disposed in a mid-portion of the plate preferably spaced nearly equidistantly radially between the mount and outer peripheral plate edge. In at least one embodiment, the circumferential ridge is of continuous construction such that the resultant ridge is continuous and uninterrupted, i.e., an annular or circular continuous and uninterrupted ridge, integrally formed in or of part of each plate. The annular continuous and uninterrupted ridge formed in each cover plate preferably strengthens at least the plate and preferably the entire brush by stiffening at least the plate and preferably the brush by reducing and preferably minimizing flexure of at least the plate and preferably the entire brush when pressure is being applied against a surface being abrasively surface treated by the brush during rotation of the brush.

A rotary radial brush constructed in accordance with the present invention has a center disc hub of 32-hole offset-hole construction with a brush wire extending radially from each hole that is formed of at least 22 wire filaments, preferably no more than 34 wire filaments, preferably no more than about 32 wire filaments, at least about 30 wire filaments, and more preferably exactly 30 wire filaments and which can be anchored to the hub using a twist knot of relatively tight twisted construction. Suitable twist knots usable to produce a tuft and/or working face at or adjacent the free end or working end of each wire include cable knots and/or stringer knots as they produce a brush wire composed of twisted brush wire filaments having a tuft width or diameter and/or a working face width and/or diameter substantially the same as that of the filaments in a straightened and parallel condition where the filaments adjoin one another along their lengthwise sides or outer surfaces.

While each brush wire of such a rotary radial brush of the present invention can be of a conventional twisted knot wire construction, e.g., standard twisted knot, cable twisted knot, or stringer bead twisted knot, each brush wire can be and preferably is one of a twisted multifilament twisted multistrand brush wire construction and a braided filament or braided strand wire construction. Such a rotary radial brush of the present invention also can include outer cover plates having at least one annular upraised ridge and/or at least a plurality of pairs, i.e., at least three, upraised radial ribs that strengthen the plate and preferably the entire brush. While such a radial rotary wire brush preferably is configured for use as a wheel wire brush that more preferably can be configured as a power wire brush, it is also contemplated that a rotary cup brush, e.g., twisted wire cup brush, can also be constructed in accordance with the present invention in a manner that incorporates one or more or all the above novel and inventive features and/or components, the 32-hole offset hole arrangement, and/or brush wire configurations.

These and other objects, features and advantages of this invention will become apparent from the following more detailed description of the invention and accompanying drawings.

DRAWING DESCRIPTION

One or more preferred exemplary embodiments of the invention are illustrated in the accompanying drawings in which like reference numerals represent like parts throughout and in which.

Figure 6A:
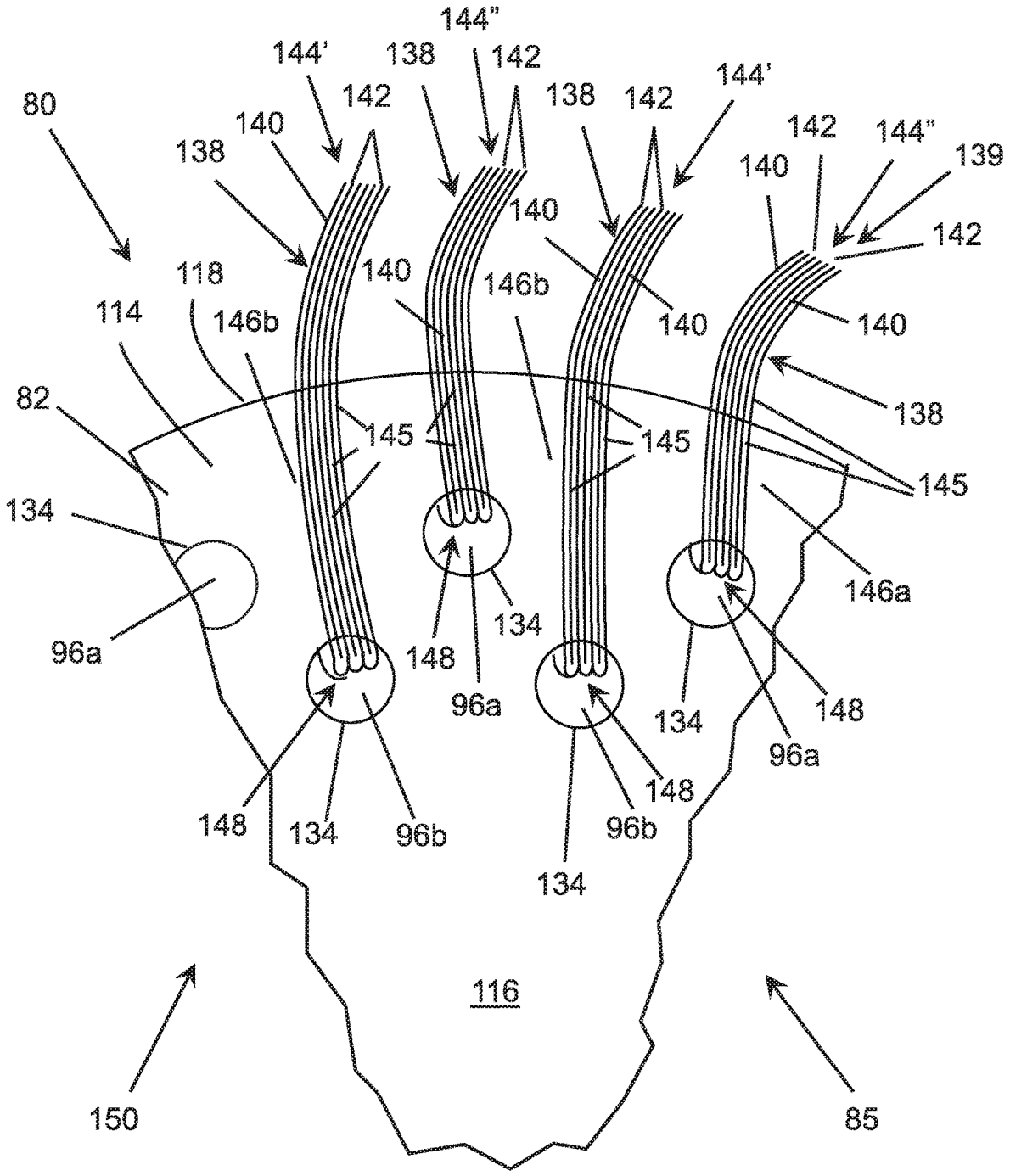
FIG. 6A is an enlarged fragmentary view of a portion of the hub of the invention of FIGS. 4 and 5 with a multifilament brush wire extending radially from each one of four of the holes in the hub.
Figure 6B:
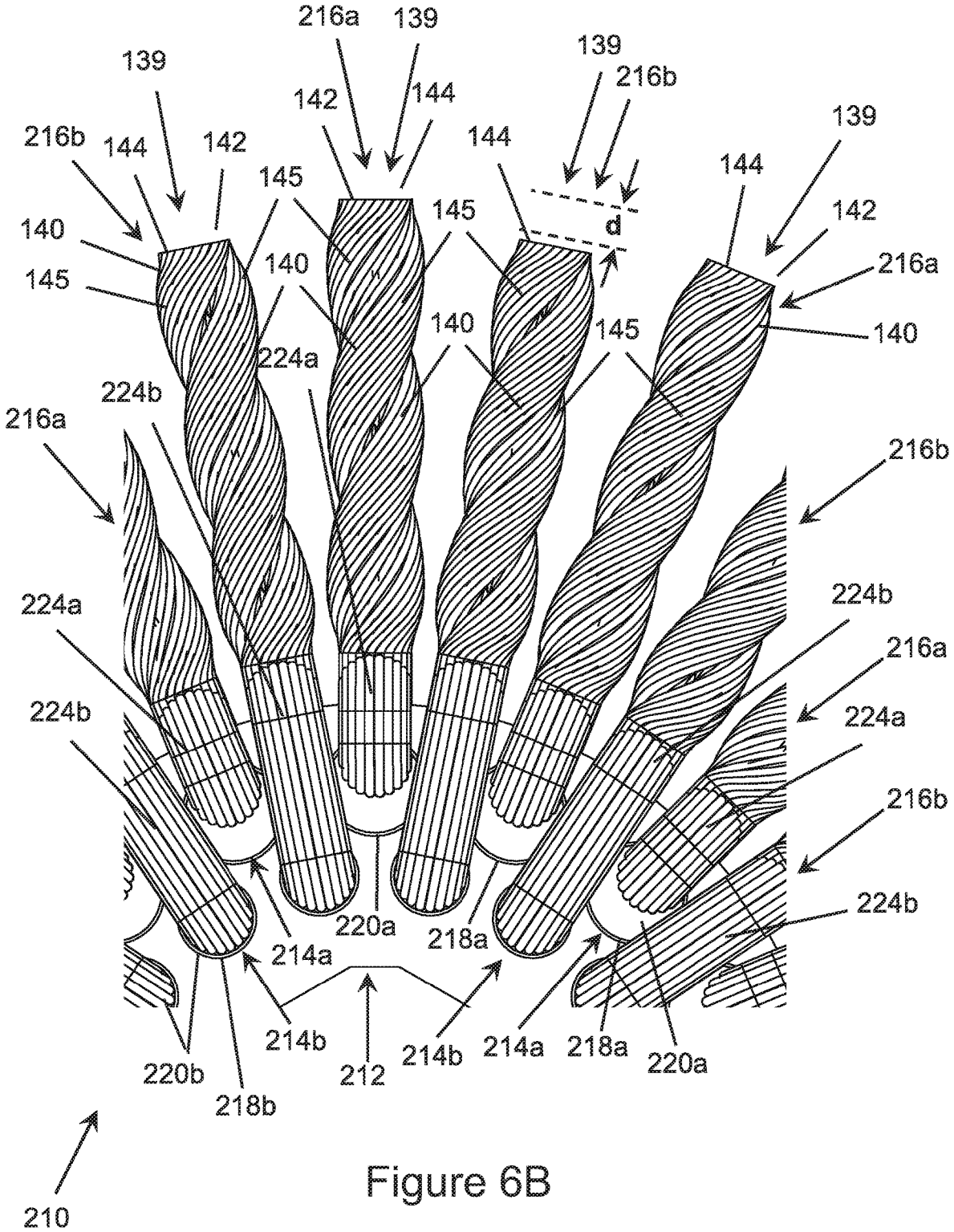
FIG. 6B is another enlarged fragmentary view of a portion of another preferred embodiment of a hub constructed in accordance with the present invention having a set of radially outer brush-wire anchoring holes larger in size than a set of radially inner brush-wire anchoring holes.
Figure 9:
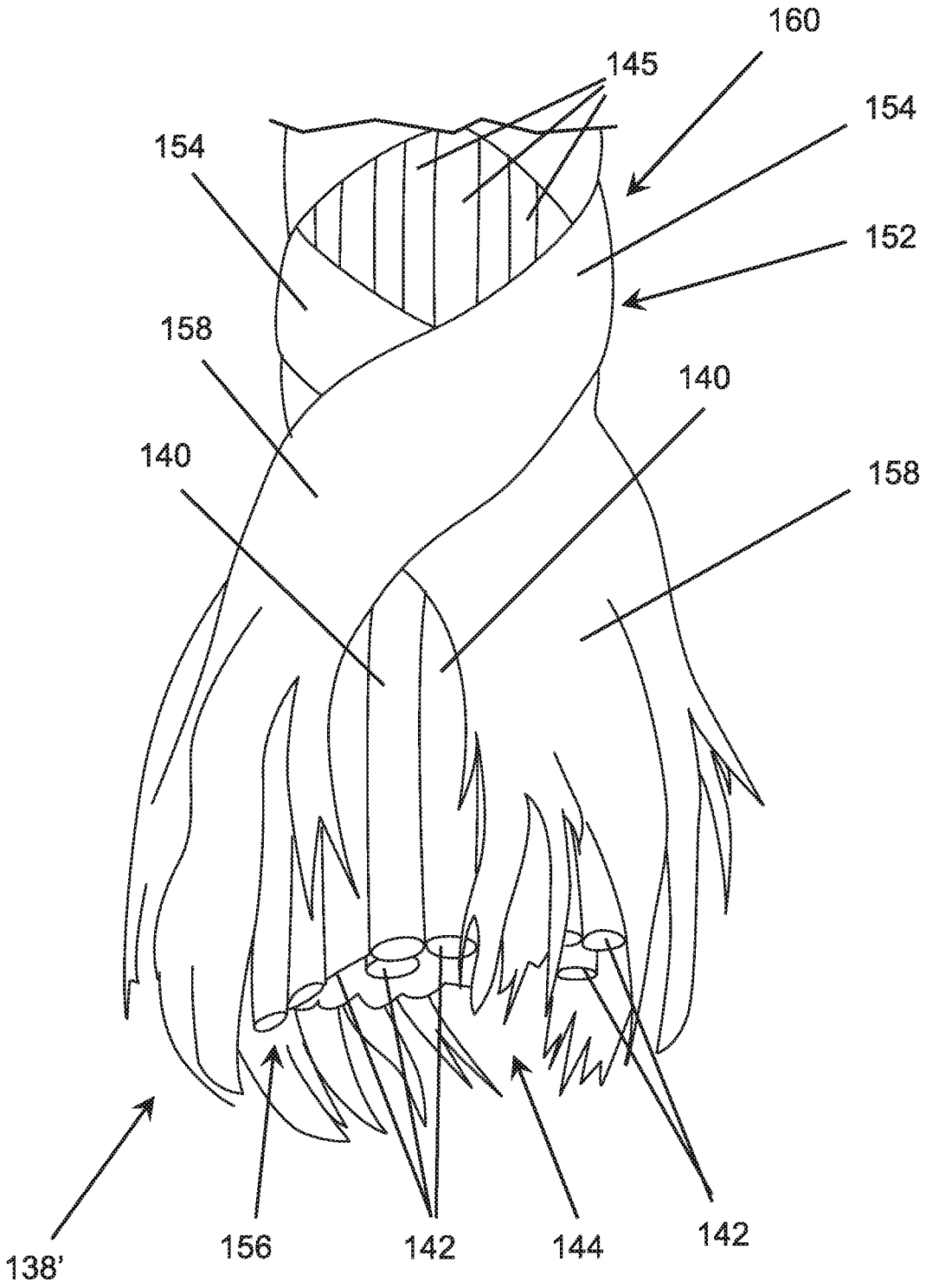
Figure 10:
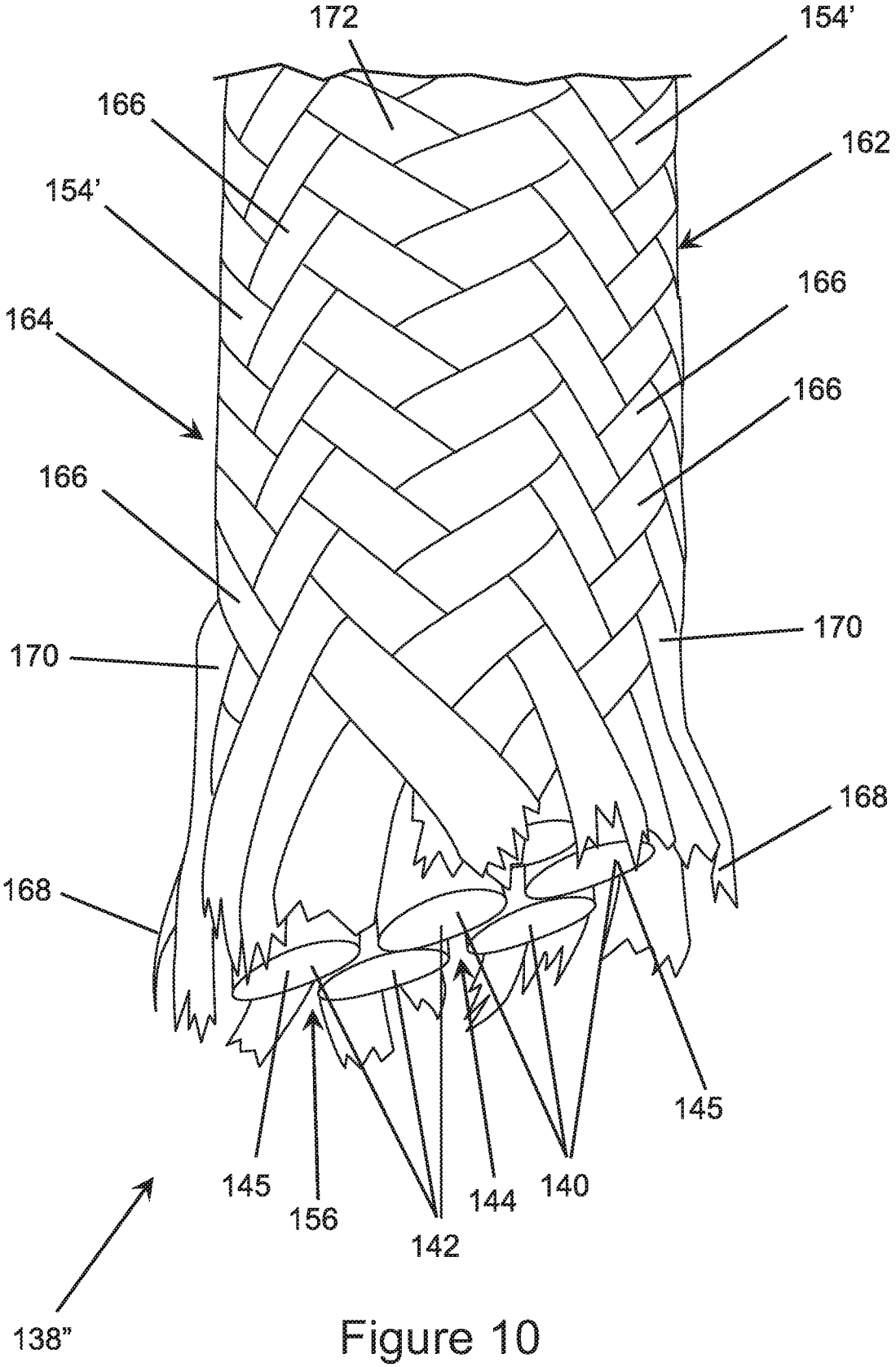
Figure 11:
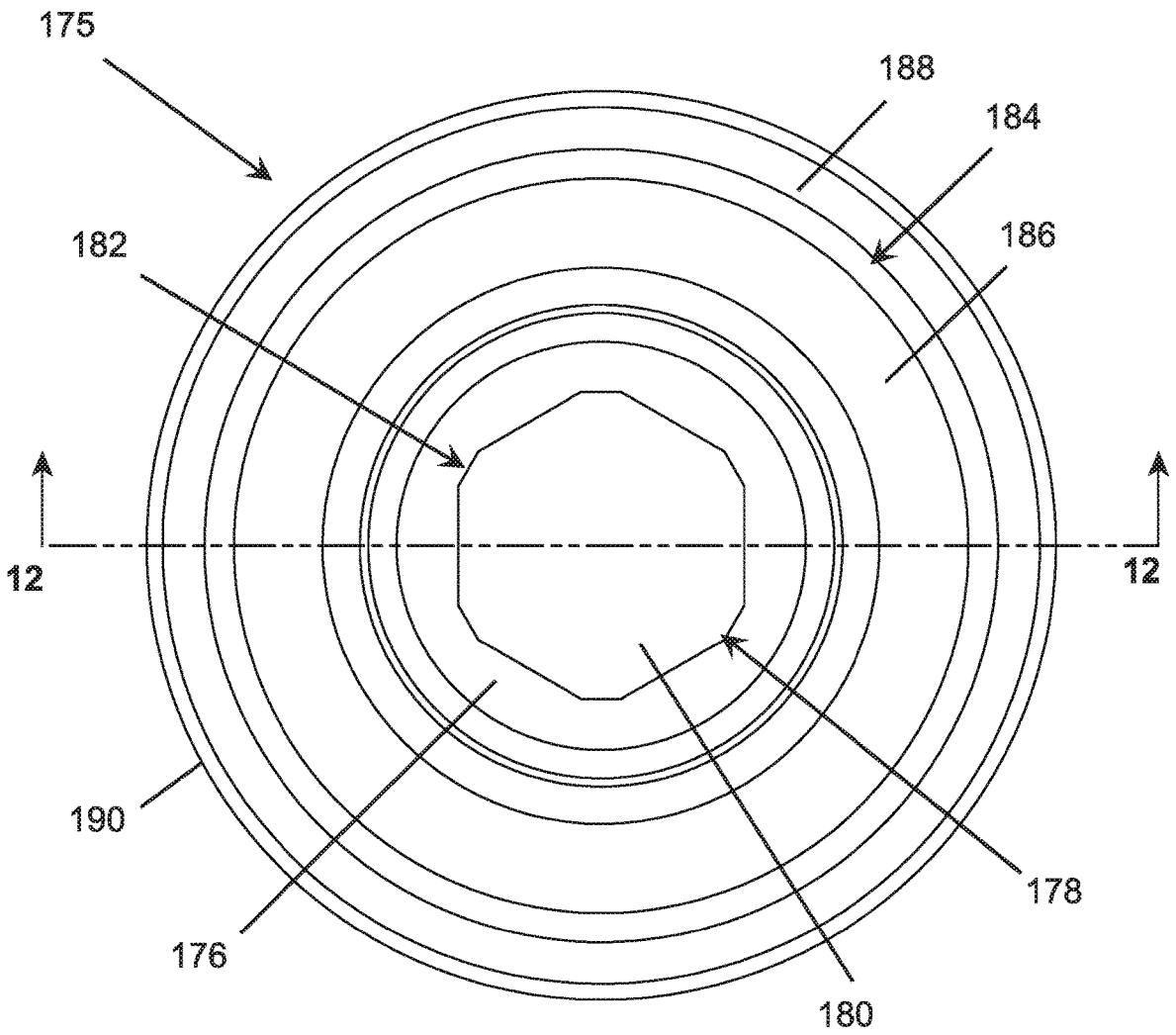
Figure 12:
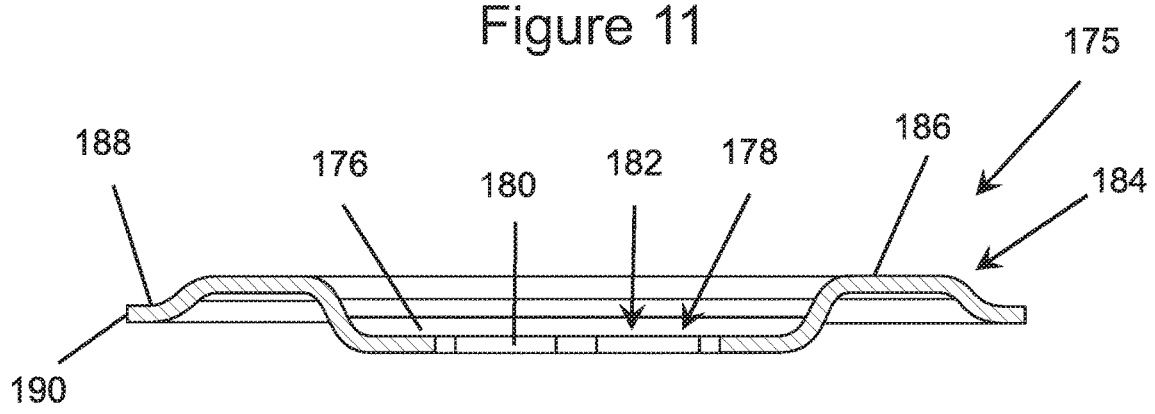
Figure 13:
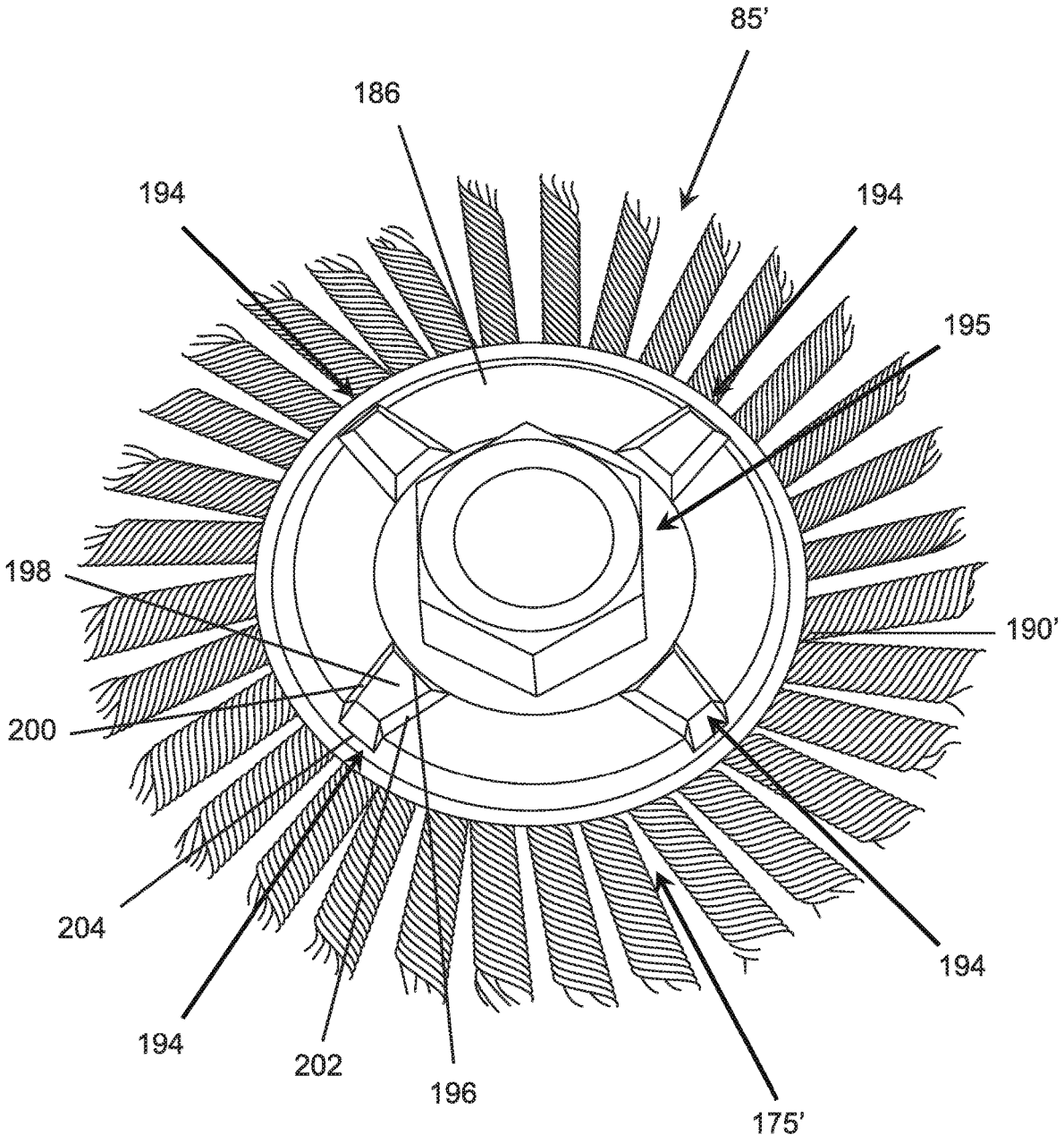
Figure 14:
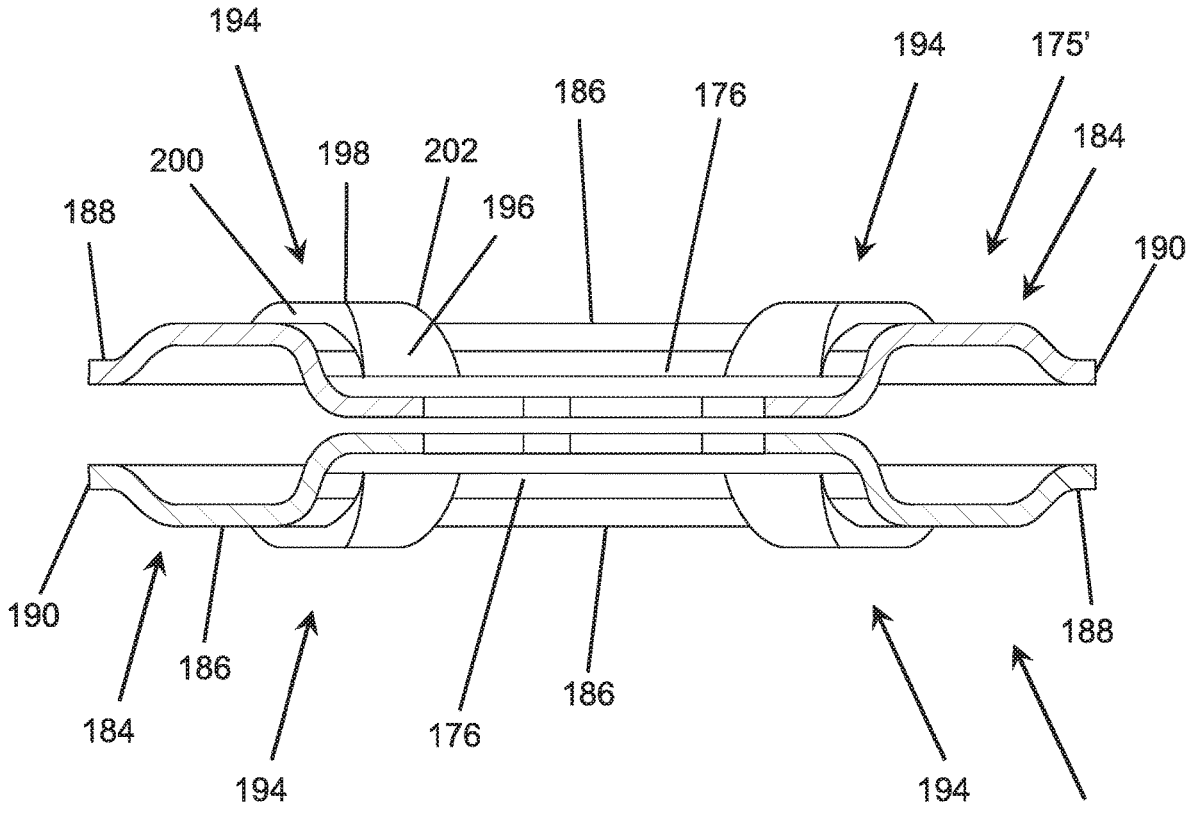
Figure 15:
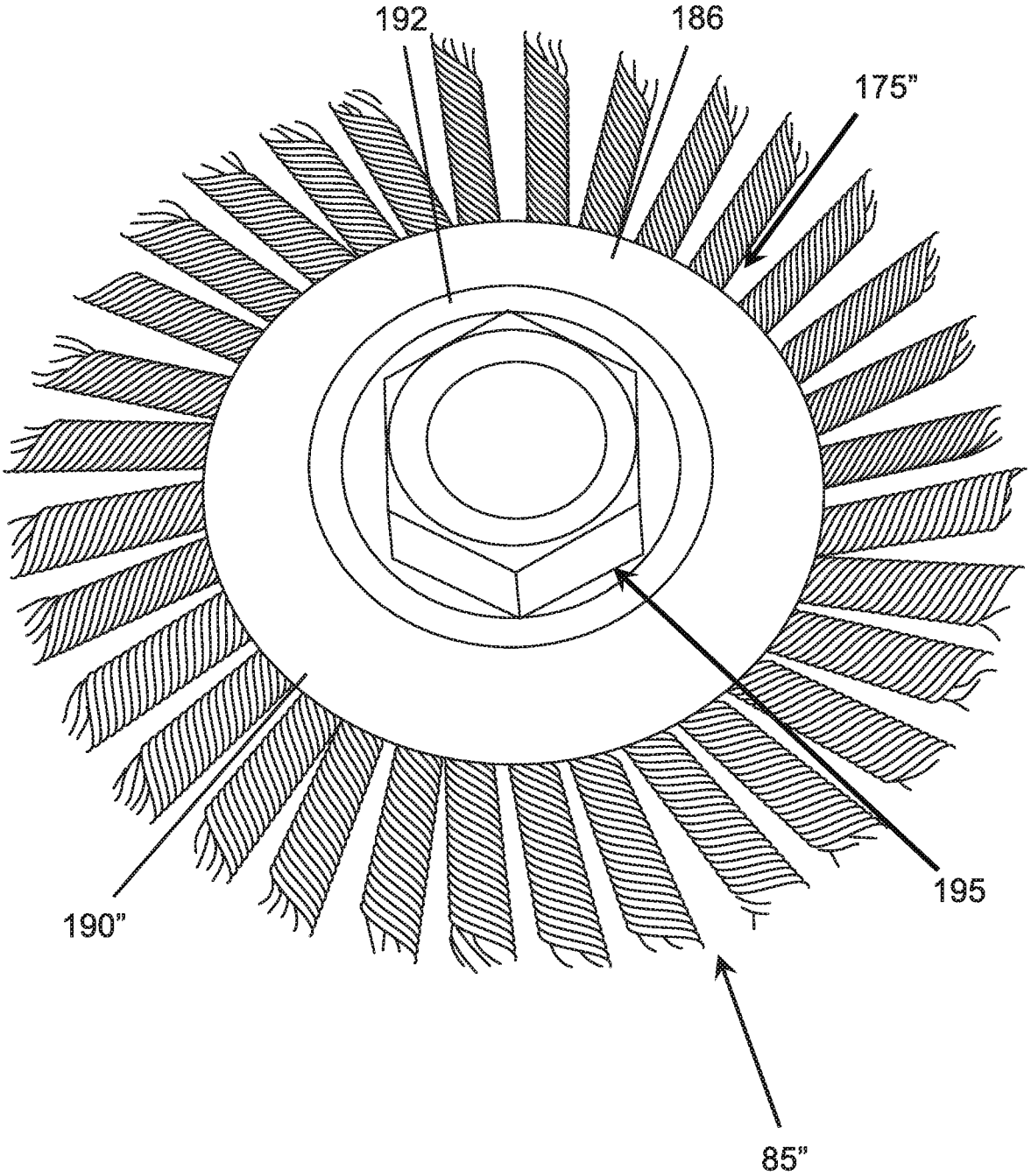
Figure 16:
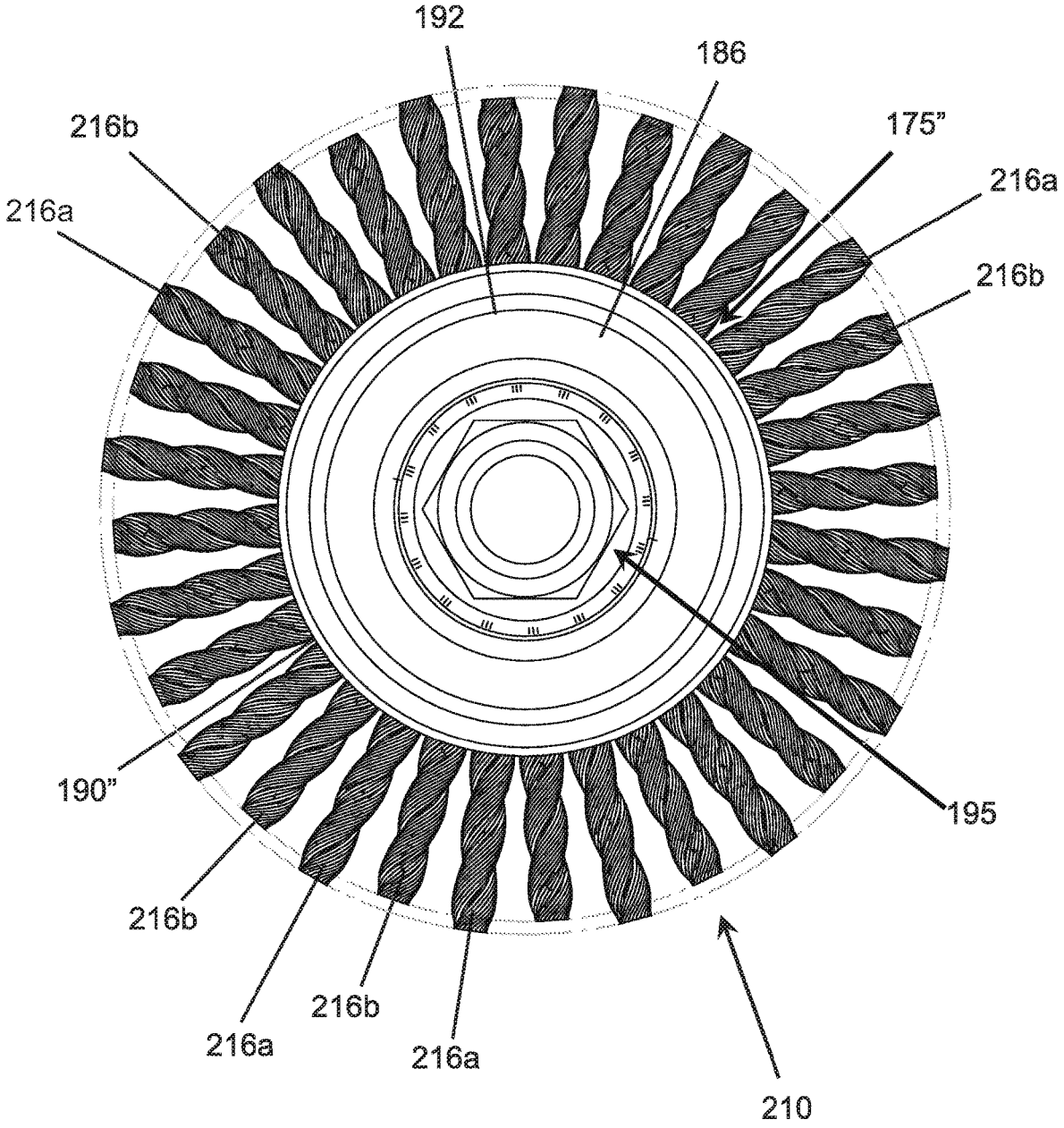

FIG. 9 is a fragmentary elevation view of an elongate portion of a second preferred embodiment of a brush wire of the present invention that also is well suited for use with rotary radial wire brush equipped with a 32-hole offset-hole hub of the invention depicting an elongate wire of a twisted filament or bristle configuration that also shows the brush filament or bristle tips of the wire that define an abrasive face at the free end of the wire;

FIG. 10 is a fragmentary elevation view of an elongate portion of a third preferred embodiment of a brush wire of the present invention that also is well suited for use with rotary radial wire brush equipped with a 32-hole offset-hole hub of the invention depicting an elongate wire of a braided or woven filament or bristle construction that also shows the brush filament or bristle tips of the wire that define an abrasive face at the free end of the wire;

FIG. 11 illustrates an exemplary but preferred embodiment of a cover plate of a rotary radial wire brush of the present invention suitable for use with the hub of FIGS. 4-6B;

FIG. 12 illustrates a cross-section of the cover plate of FIG. 11 taken through line 12-12 of FIG. 11;

FIG. 13 is a top plan view of a preferred embodiment rotary radial wire brush of the invention made with an outer cover plate of strengthened construction having a plurality of pairs of radially extending upraised ribs formed in the plate;

FIG. 14 is a fragmentary view of a rotary radial brush made with a pair of the cover plates of FIG. 13 with the wire-carrying brush removed for clarity;

FIG. 15 is a top plan view of a preferred embodiment of a rotary radial wire brush of the invention made with an outer cover plate of having at least one upraised circumferentially extending ridge formed in the plate; and FIG. 16 is a top plan view of a preferred embodiment of a rotary radial wire brush of the present invention made with the central disc hub shown in FIG. 6B producing alternating brush wires that extend radially outwardly from the hub different lengths as depicted in FIG. 16.

Before explaining one or more embodiments of the invention in detail, it is to be understood that the invention is not limited in its application to the details of construction and the arrangement of the components set forth in the following description or illustrated in any appended drawings. The invention is capable of other embodiments, which can be practiced or carried out in various ways. Also, it is to be understood that the phraseology and terminology employed herein is for the purpose of description and should not be regarded as limiting.

DETAILED DESCRIPTION

As discussed in more detail below, the present invention is directed to a rotary radial wire brush of the type used for abrasive material removal in performing a surface treatment or surface finishing operation and which preferably is a wire wheel brush and which can be a power brush well suited for use in weld surface preparation, cleaning of finished welds, e.g., slag removal, rust removal, paint removal, deburring, and/or other types of abrasive material removal, abrasive surface treatment, and abrasive surface finishing applications. Depending on the type of surface to be treated, the amount of material which needs to be removed, the depth of which material can be abrasively removed, and other factors, such a rotary wire brush constructed in accordance with the present invention can also be used for other types of abrasive material removal applications, such as even some grinding applications where a rotary grinding wheel might also be used. Such a rotary wire brush can be and preferably is electrically or pneumatically powered, such as by a rotary power tool that can be a grinder, such as an angle grinder, e.g., right angle grinder, a straight grinder, a die grinder, or a bench grinder, a drill, a drill press, or another type of rotary electric or pneumatic power tool.

Figure 1:
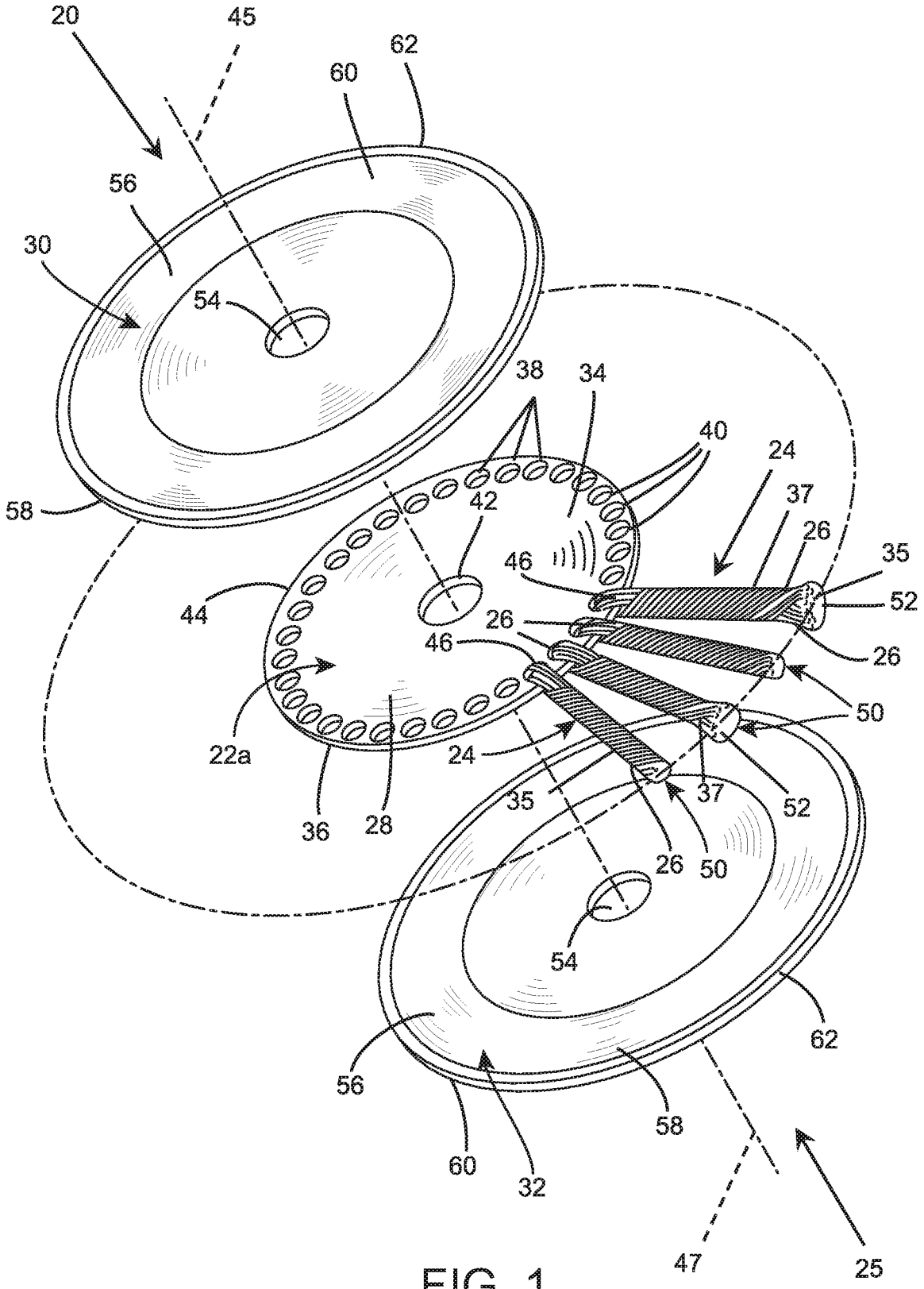
FIG. 1 (PRIOR ART)
FIG. 1 is an exploded perspective view of a prior art rotary radial wheel wire brush assembly illustrating a conventional central disc hub with brush-anchoring holes uniformly circumferentially spaced about the periphery of the hub from which brush wires radially extend and having a pair of circular cover plates sandwiching the hub.

With reference to the drawing figures, FIG. 1 illustrates an exemplary rotary radial wire brush assembly 20 of a rotary radial wire brush 25 of generally the same construction as a rotary radial brush assembly constructed in accordance with the present invention but which differs in having a conventional disc-shaped brush wire carrying central hub 22*a* from which circumferentially spaced abrasive wires 24 each formed of bundles of twisted wire filaments 26 radially outwardly extend. The brush assembly 20 further includes a pair of generally circular cover plates 30, 32 between which is sandwiched the generally circular body or platter 28 of the hub 22*a* with the cover plates 30, 32 covering respective oppositely outwardly facing outer platter surfaces 34, 36 of the hub 22*a*. As discussed in more detail below, a rotary radial wire brush and assembly constructed in accordance with the present invention employs a novel disc-shaped central hub that enables radially outwardly extending brush wires each having a greater number of wire filaments to be anchored to the hub producing a radial wire brush in accordance with the present invention having an optimal combination of long brush life and outstanding abrasive material removal characteristics.

With continued reference to FIG. 1, hub 22*a* has wire-seating holes 40 circumferentially spaced apart about the entire periphery of the hub 22*a* with each hole 40 being part of a corresponding brush anchor 38 that also includes a portion of the hub platter 28 extending from the hole 40 radially outwardly to an outer peripheral edge 44 of the hub 22*a*. The wire-seating holes 40 are equiangularly spaced apart and extend circumferentially about the periphery 44 of the hub 22*a* with each one of the holes 40 spaced the same radial distance from a center 45 of the hub 22*a* that also is substantially coincident with an axis 47 about which the hub 22*a* and brush 25 rotates during abrasive material removal use and operation. As is also shown in FIG. 1, the brush-seating holes 40 are also radially spaced from a rotary drive mounting arbor hole 42 of the hub 22*a* through which the hub center 45 and rotation axis 47 centrally extends.

As shown in FIG. 1, all the wire-seating holes 40 are arranged in a circle circumferentially in line with one another spaced a common distance inboard of the outer radial peripheral edge 44 of the hub 22*a*. An elongate radially extending brush wire 24 is seated in each hole 40 that is formed of elongate wire filaments 26 twisted in a manner that anchors the filaments 26 and wire 24 to the portion of the hub 22*a* disposed radially between the hole 40 and peripheral hub edge 44 using a twisted knot 46, that can be a standard twist knot, a cable twist knot or a stringer bead twist knot. Each brush wire 24 is formed of up to 14 wire filaments 26 that extend radially outwardly from each hole 40 and which are twisted along at least a portion of the length of the wire 24 as a result of being twist knot anchored to the corresponding brush anchor 38 of the hole 40 forming up to 28 brush wire bristles 35. The twisted filaments 26 of each wire 24 forms an elongate tuft 37 with the filament tips 52 of each wire 24 forming an abrasive surface-contacting head 50 at the end of the wire 24.

As is also shown in FIG. 1, each cover plate 30, 32 is generally circular and generally coaxial with the central hub 22*a* sandwiched between the plates 30, 32 with the plates 30, 32 having a generally circular arbor hole 54 coaxially aligned with the arbor hole 42 in the hub 22*a*. Each cover plate 30, 32 has a generally circular body 56 with an interior facing surface 58 facing toward a respective one of the oppositely outwardly facing surfaces 34, 36 of the hub 22*a* and an exterior facing surface 60 facing outwardly away from the hub 22*a*. When the cover plates 30, 32 of the brush assembly 20 are fixed to the hub 22*a*, the cover plates 30, 32 radially overlap opposite sides 34, 36 of the hub 22*a* including the brush anchors 38 and holes 40 of the hub 22*a* as well as the twisted knots 46 with an outer radial edge 62 of each plate 30, 32 overlapping a portion of the radially extending filaments 26 of each brush wire 24 extending radially outwardly beyond the radial edge 44 of the hub 22*a*.

Figure 2:
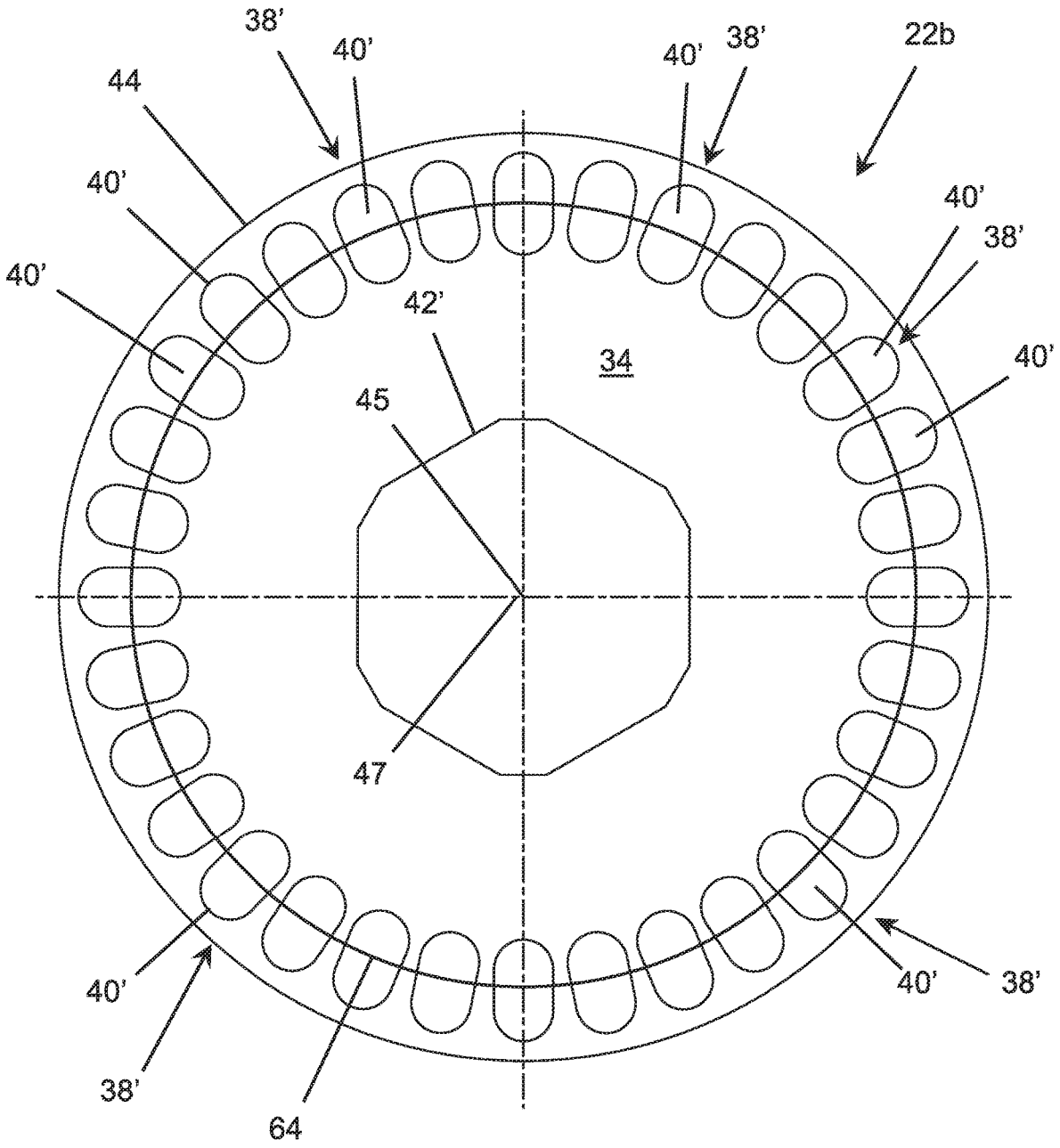
FIG. 2 (PRIOR ART)
FIG. 2 is a plan view of a prior art rotary radial brush center disc hub having 32-slots of a circumferentially aligned configuration where all the slots are spaced circumferentially about the periphery of the hub the same radial distance from a center of the hub.

FIG. 2 illustrates a second prior art rotary brush center disc hub 22*b* of circular and substantially flat or planar construction of a 32-hole circumferentially aligned configuration having radially extending oblong brush wire seating slots 40', each of which also forms part of a corresponding brush anchor 38' extending radially outwardly therefrom to the outer peripheral edge 44 of the hub 22*b*. The slots 40' are equiangularly spaced apart and circumferentially aligned with all of the slots 40' spaced the same radial distance from the center 45 and rotational axis 47 of the hub 22*b*. As such, each one of the slots 40' has a radial centerline spaced the same radial distance from the hub center axis 45 such that the radial centerlines of all the slots 40' lie along a circle 64 coaxial with the center of the hub 22*b*, e.g., the hub center axis 45.

Figure 3:
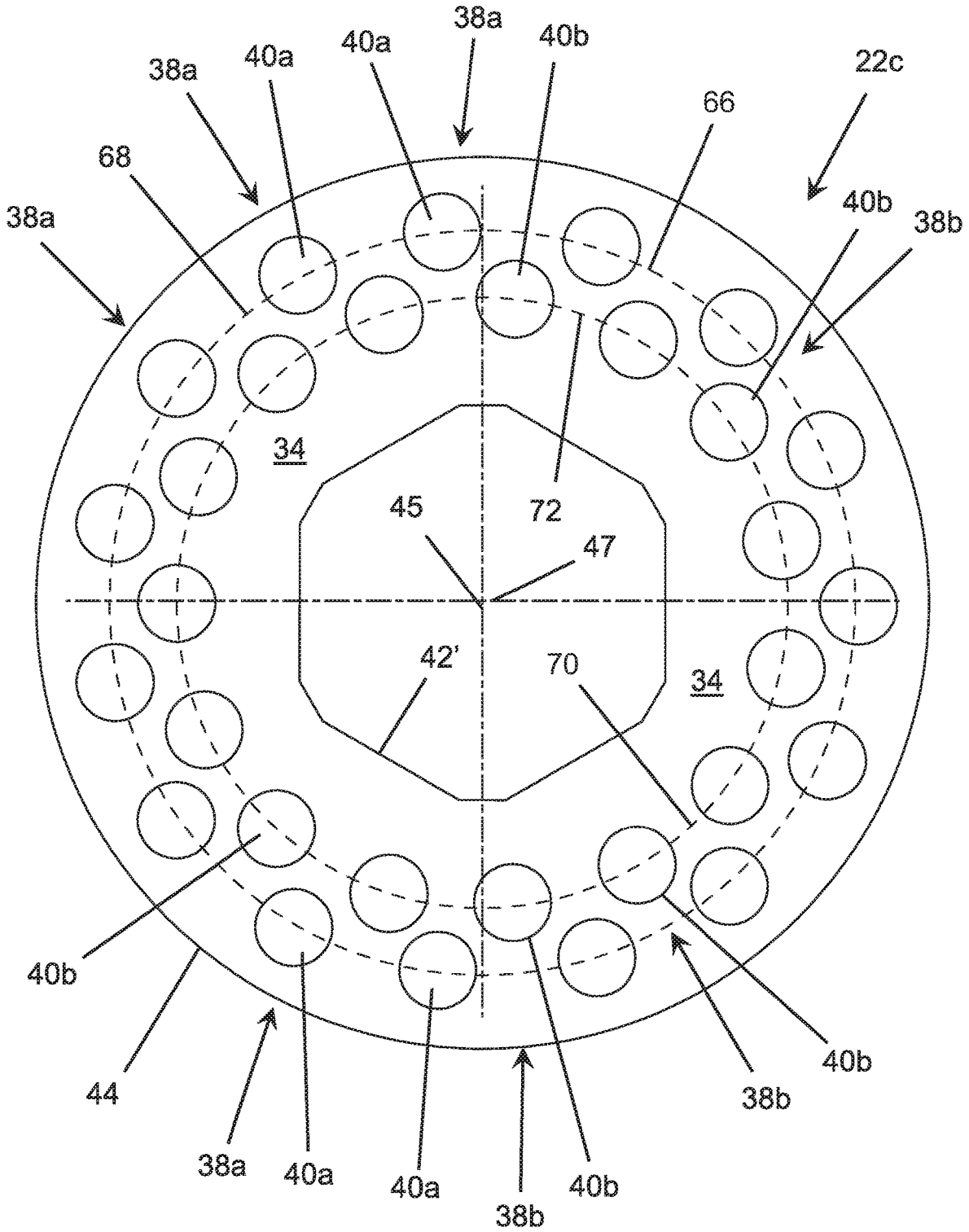
FIG. 3 (PRIOR ART)
FIG. 3 is a plan view of a prior art rotary radial brush center disc hub of a prior art 30-hole offset hole configuration where alternating holes are staggered or offset two different radial distances from the center of the hub.

FIG. 3 illustrates a third prior art rotary brush central disc hub 22*c* of circular and substantially flat or planar construction of a 30-hole offset hole configuration where the brush seating holes 40*a* and 40*b* and brush-anchors 38*a* and 38*b* are arranged with an alternating staggered radial offset. As also shown in FIG. 3, the hub 22*c* has a first or radially outermost set of holes 40*a* with circumferentially extending centerlines 66 spaced a first radial distance from the hub center 45 or rotational axis 47 along a first radially outermost circle 68 and a second or radially innermost set of holes 40*b* with circumferentially extending centerlines 72 spaced a second radial distance from the hub center 45 or rotational axis 47 along a second radially innermost circle 70 having a radius less than that of the outermost circle 68.

Figure 4:
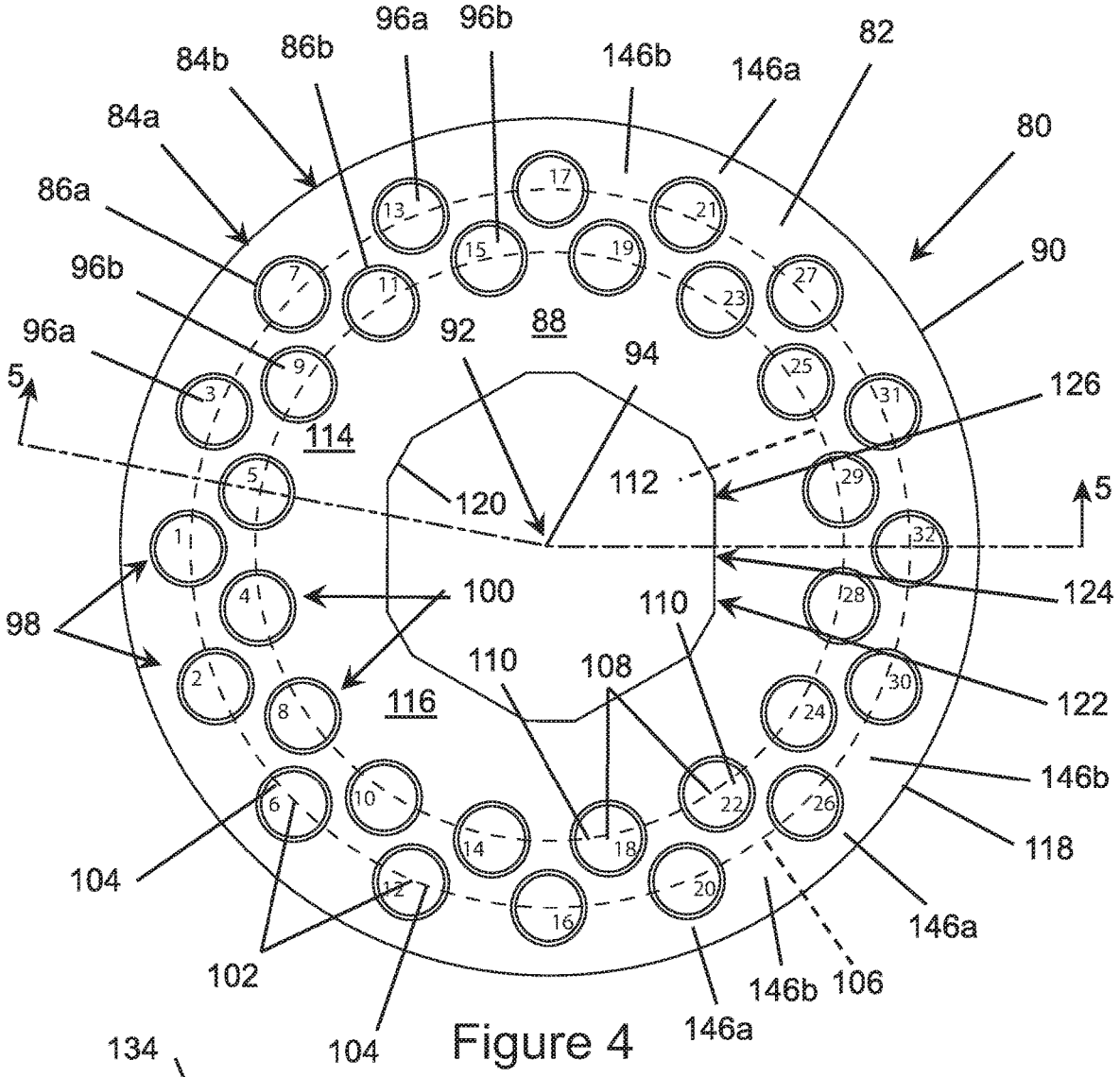
FIG. 4 is a plan view of a rotary radial brush center disc hub of the present invention having 32-holes of an offset hole configuration where the brush anchoring holes are alternatingly staggered two different radial distances from the center of the hub.
Figure 5:
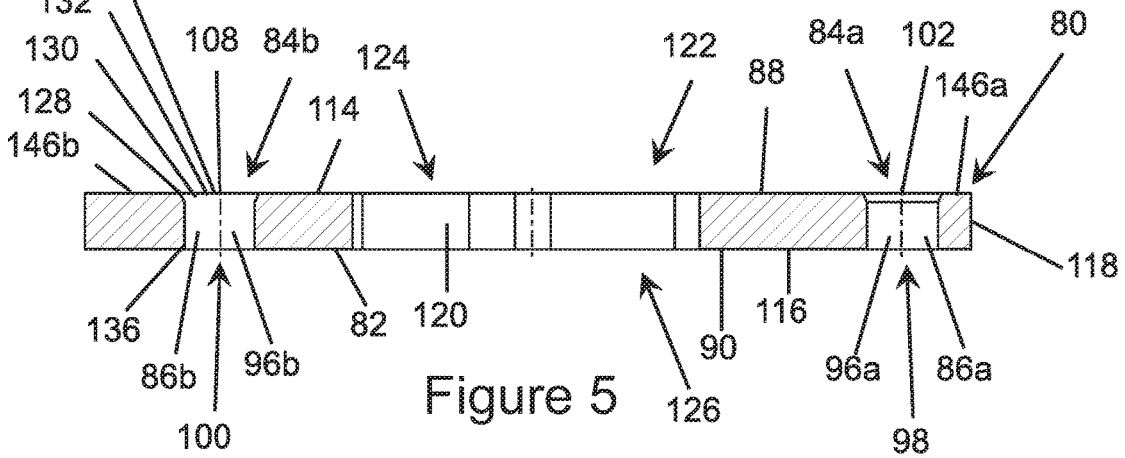
FIG. 5 is a cross-sectional view of the hub of FIG. 4 taken through line 5-5 of FIG. 4.

FIGS. 4-6A illustrate a rotary radial wire brush disc-shaped center hub 80 constructed in accordance with the present invention that is formed of a generally circular metal disc or plate 82 preferably made of hot rolled steel having a suitably high toughness, a desirably durable surface finish, and a hardness of at least 50 Rockwell B. As depicted in FIGS. 4 and 6A, the hub 80 has at least a plurality of pairs of, i.e., at least three, circumferentially spaced apart and radially offset wire-holding apertures 86*a* and 86*b* with respective brush wire anchors 84*a* and 84*b* disposed radially outwardly thereof. The circular metal disc or plate 82 of the hub 80 includes or is formed of an annular body or platter 114 with annular webbing 116 extending radially inwardly from the apertures 86*a* and 86*b* to a radially inner peripheral edge 120 of the hub 80 that can and preferably does define at least part of a mount 122 that preferably is in the form of a generally hexagonal rotary prime mover or tool coupling 124 of a rotary radial wire brush constructed with the hub 80 that can be a generally centrally disposed arbor hole 126 or the like.

A rotary radial wire brush 85 (FIG. 6A) of the present invention made with such a hub 80 constructed in accordance with the present invention can have or be configured with a different type of mounting or coupling arrangement, such as one employing a coupling ring, a coupling nut, twist-lock coupling, spindle lock coupling, or another type of coupling arrangement for removably fixing the brush 85 and/or hub 80 to an electrically or pneumatically powered rotary prime mover that can be a rotary power tool, such as a grinder, drill, drill press, or another type of rotary drive. Such a brush 85 made with a hub 80 constructed in accordance with the present invention is capable of being rotated by such a rotary prime mover or rotary drive at rotational speeds of at least 500 revolutions per minute (RPM), preferably at least 5000 RPM, and more preferably at least 10000 RPM or even faster. In at least one preferred embodiment, a rotary radial wire brush 85, e.g., wheel brush or power brush, constructed with such a hub 80 in accordance with the present invention can be rotated at rotational speeds of greater than 25000 RPM, more preferably at rotational speeds of greater than 35000 RPM and more preferably at rotational speeds of greater than 50000 RPM.

With reference once again to FIGS. 4 and 6A, each one of the apertures 86*a* and 86*b* preferably is a circular or round wire-seating through hole 96*a* and 96*b* that each extends generally in an axial direction completely through oppositely outwardly facing surfaces 88, 90 and a body or platter 114 of the hub 80. As also shown in FIGS. 4 and 6A, each one of the wire-holding apertures 86*a* and 86*b*, preferably circular or round wire-seating holes 96*a* and 96*b*, are generally equiangularly circumferentially spaced apart about substantially the entirety of the circular body or platter 114 of the hub 80 with each one of the apertures 86*a*, preferably holes 96*a*, radially staggered relative to each adjacent one of the apertures 86*b*, preferably holes 96*b* producing a hub 80 of the present invention used in the manufacture of a rotary radial wire brush 85, preferably a wheel wire brush, e.g., a power brush, constructed in accordance with the present invention as discussed in more detail below.

With continued reference to FIGS. 4 and 6A, a preferred hub 80 constructed in accordance with the present invention is of an offset hole configuration having at least 32 apertures 86*a* and 86*b*, preferably circular or round holes 96*a* and 96*b*, generally equiangularly spaced apart about a circumference of the hub 80 and which are alternatingly spaced at least a plurality of different radial distances from a center 92 of the hub 80 that preferably also is substantially coincident with a center axis of rotation of a brush 85 of the present invention made with the hub 80. One particularly preferred hub 80 of the present invention has exactly 32 apertures 86*a* and 86*b* each of which preferably respectively are generally circular or round holes 96*a* and 96*b* that are equiangularly spaced apart two different radial distances from the hub center 92 or brush rotational axis 94 producing a hub 80 of 32-hole radially offset hole construction or configuration. As best shown in FIG. 4, the 32 apertures 86*a* and 86*b*, preferably 32 holes 96*a* and 96*b*, of hub 80 are equiangularly circumferentially spaced apart and arranged in such a radially staggered offset configuration where every other aperture 86*a*, preferably hole 96*a*, is radially offset from every aperture 86*b*, preferably hole 96*b*, adjacent thereto. Such a 32-hole offset hole configured hub 80 thereby has two different sets 98, 100 of the apertures 86*a* and 86*b* or holes 96*a* and 96*b* with two different radial spacings from the hub center 92 and/or rotational brush axis 94 with one set 98 of the apertures 86*a* or holes 96*a* being radially outermost disposed from or relative to the hub center 92 or brush rotation axis 94 and the other set 100 of the apertures 86*b* or holes 96*b* being radially innermost disposed from or relative to the hub center 92 or rotational axis 94.

As best shown in FIG. 4, the first set 98 of the circular holes 96*a* formed in hub 80 are spaced a first distance from the hub center 92 or rotational axis 94 that is greater than a second set 100 of the round holes 96*b* that are radially spaced a second lesser radial distance from hub center 92 or axis 94. As depicted in FIG. 4, apertures 86*a*, and/or holes 96*a* of the first or radially outermost spaced set 98 are equiangularly and circumferentially spaced an equal distance apart from each other having centers 102 and radial circumferentially extending center lines 104 lying along a first common circle 106 having a first radially outermost disposed radius from hub center 92 or brush rotational axis 94. With continued reference to FIG. 4, the apertures 86*b*, and/or holes 96*b* of the second or radially innermost spaced set 100 are also equiangularly and circumferentially spaced an equal distance apart from each other having centers 108 and radial circumferentially extending center lines 110 lying along a second common circle 112 having a second radially innermost disposed radius from hub center 92 or brush rotational axis 94 that is less than the first radius of circle 106. As is also depicted in FIG. 4, the first and second sets 98, 100 are substantially coaxial as are circles 106, 112.

With reference to FIGS. 4 and 5, the brush anchors 84*a* and 84*b* are respectively formed by corresponding aperture 86*a* and 86*b*, preferably by corresponding hole 96*a* and 96*b*, and includes a respective portion of the body or platter 114 of the hub 80 that is or includes a corresponding margin 146*a* and 146*b* extending radially outwardly from at or adjacent aperture 86*a* and 86*b*, preferably hole 96*a* and 96*b*, to at or adjacent the radially outermost edge 118 of the hub 80. As with the apertures 86*a* and 86*b* and/or holes 96*a* and 96*b*, brush anchors 84*a* and 84*b* are equiangularly circumferentially spaced apart about the hub 80 with each one of the brush anchors 84*a* and 84*b* disposed radially outwardly of respective apertures 86*a* and 86*b* and/or holes 96*a* and 96*b*. Brush anchors 84*a* and 84*b* respectively provide a corresponding portion of the body or platter 114 of the hub 80 including margin 146*a* and 146*b* extending radially outwardly to the outer hub edge 118 for a brush wire 138 received in each aperture 86*a* and 86*b* or seated in each hole 96*a* and 96*b* to wrap around, loop around, and/or be twisted around, such as via a twisted knot 148, or another suitable brush wire anchoring arrangement, configuration or method used to anchor brush wires 138 to hub 80. As apparent from FIG. 4, hub 80 has the same number of brush anchors 84*a* and 84*b* as apertures 86*a* and 86*b* or holes 96*a* and 96*b*. Where hub 80 is configured with 32 radially offset apertures 86*a* and 86*b* or holes 96*a* and 96*b*, the hub 80 also has 32 brush anchors 84*a* and 84*b* spaced apart about the outer periphery of the hub 80 with anchors 84*a* having a shorter radial extent or smaller margin 146*a* than the larger radial extent or greater margin 146*b* of anchors 84*b*.

As discussed in more detail below, such a hub 80 is constructed with at least 32 brush anchors 84*a* and 84*b* which preferably respectively include at least 32 apertures 86*a* and 86*b* arranged in an offset aperture configuration that enables a greater number of apertures 86*a* and 86*b* to be employed for a hub 80 of a given diameter as compared to a conventional hub of the same diameter. A preferred rotary radial brush 85 constructed with such a hub 80 of offset aperture construction preferably is configured or formed with exactly 32 brush anchors 84*a* and 84*b* that operably cooperate with 32 respective brush-holding apertures 86*a* and 86*b* arranged in a radially offset configuration to advantageously enable a radial brush 85 of the present invention to be produced with brush wires 138 each having at least a plurality of pairs of, i.e., at least three, elongate folded and/or twisted brush wire filaments 145 that form at least 29 brush wire bristles 140, preferably at least 30 bristles 140, extending radially outwardly from each aperture 86*a* and 86*b* and which are anchored by respective anchor 84*a* and 84*b*.

As discussed in more detail below, a rotary radial wire brush 85, e.g., wheel wire brush or power brush, produced with such a hub 80 having a radially offset 32-hole configuration with 32 apertures 86*a* and 86*b* each of which preferably are circular or round holes 96*a* and 96*b* radially offset in the manner depicted in FIGS. 4-6A each having an elongate radial brush wire 138 of multifilament construction with at least 29 brush bristles 140 per wire 138 and which has about 30 bristles 140 per wire 138 (30±1 bristles per bundle). In one preferred brush and hub embodiment, each brush wire 138 is formed of enough filaments 145 to produce a wire 138 having at least 29 bristles 140 per wire 138 and which preferably has at least about 30 bristles 140 per wire 138. In one such preferred brush and hub embodiment, each brush wire 138 is formed of at least 15 elongate brush wire filaments 145 that extend through each hole 96*a* and 96*b* in the hub 80 and which are anchored, such as via a twisted knot 148, to corresponding anchor 84*a* and 84*b* such that each wire 138 has at least 30 bristles 140 extending radially beyond the outer peripheral edge 118 of the hub 80. In another such preferred brush and hub embodiment, each one of the 32 holes 96*a* and 96*b* of the hub 80 arranged in a radially offset configuration has an elongate brush wire 138 extending radially outwardly therefrom that is formed of exactly 15 wire filaments 145 such that each brush wire 138 has exactly 30 bristles that extend radially outwardly beyond the outer peripheral hub edge 118.

With reference once again to FIG. 6A, such an assembly 150 of a 32-hole radially offset hub 80 and brush wires 138 advantageously produces a rotary wire brush 85 constructed in accordance with the present invention having a higher material removal rate and which preferably advantageously also maintains such a high or higher material removal rate for a longer period of time as compared to conventional prior art brushes made with a conventional prior art hub of the same diameter equipped either with a 32 hole circumferentially aligned hole pattern or a 30 hole radially offset hole pattern. As such, the performance of such a rotary radial wire brush 85 of the present invention made of such a hub and wire assembly 150 of a radially offset 32-hole hub 80 constructed in accordance with the present invention with each hole 96*a* and 96*b* having a 30-bristle brush wire 138 extending radially outwardly therefrom radially outwardly beyond the outer peripheral hub edge 118 is unexpectedly significantly better than expected.

FIG. 5 depicts a cross section of the hub 80 taken along line 5-5 of the hub 80 shown in FIG. 4 that extends (a) through one of the radially outermost apertures 86*a* or holes 96*a* and corresponding brush anchor 84*a*, and (b) through one of the radially innermost apertures 86*b* or holes 96*b* and corresponding brush anchor 84*b*. As is also shown in FIG. 5, where the brush anchors 84*a* and 84*b* operatively cooperate with apertures 86*a* and 86*b* that are round or circular holes 96*a* and 96*b* in receiving and retaining a brush wire 138 anchored thereto, at least one and preferably both hole corner edges 134 and/or 136 is configured with a brush wire contact surface area increasing stress relief 128 formed of or by a diametrically enlarging bevel 130 produced by a chamfer 132 extending about at least one of the top or bottom peripheral hole edges 134 and/or 136. While only the top or upper peripheral hole edge 134 of each one of the holes 96*a* and 96*b* of the hub 80 of FIG. 5 is shown as being configured with such a brush wire contact surface area increasing stress relief 128 formed of a hole entrance diameter enlarging bevel 130, such as produced by a chamfer 132, a preferred embodiment of such a hub 80 constructed in accordance with the present invention can and preferably does have both hole edges, i.e., top and bottom edges 134 and 136, of each hole 96*a* and 96*b* so configured. As discussed in more detail below, such a stress-relieving and/or brush wire contact surface area increasing hole arrangement can advantageously extending brush life as well as facilitate including one or more additional brush wires 140 in each brush wire bundle 138 of a rotary radial brush constructed with such a hub 80 configured in accordance with the present invention.

With continued reference to FIG. 6A, the hub 80 depicted in FIGS. 4 and 5 has a brush wire 138 extending outwardly from every hole 96*a* and 96*b* and which is anchored to the hub 80 via corresponding brush anchor 84*a* and 84*b*, such as via twist knot anchoring. Where anchored to each brush anchor 84*a* and 84*b* using a twisted knot 148 or the like, portions of the elongate filaments 145 that form the bristles 140 of each wire 138 extend radially outwardly beyond the outer hub radial peripheral edge 118 with the tips 142 at the free ends of the bristles 140 defining an abrasive brush wire face 144. Each brush wire 138 preferably is of metal or metallic construction with each wire 138 made of filaments 145 preferably composed of steel, such as a high carbon steel, stainless steel, or another steel suitable for use in wire brushes as known in the industry.

During surface finishing operation, the abrasive face 144 formed of the tips 142 of the bristles 140 of each wire 138 of the rotating brush 85 depicted in FIG. 6A contacts and abrades a surface to be finished abrasively by abrasively removing material therefrom. A preferred rotary radial wire brush embodiment constructed in accordance with the present invention has at least 29 bristles 140, preferably has about 30 bristles 140 (30±1 wires per wire 138), and more preferably has exactly 30 bristle 140 per wire 138 attached or otherwise anchored to the hub 80 via a corresponding one of the brush anchoring holes 96*a* and 96*b* and/or brush anchors 84*a* and 84*b*. The filaments 145 of each wire 138 extend through each one of the holes 96*a* and 96*b* in the hub 80 and are anchored by wrapping and/or twisting the filaments 145 around a respective brush-wire anchor forming margin 146*a* and 146*b* of the hub 80 that extends radially outwardly between corresponding hole 96*a* and 96*b* and radially outermost peripheral edge of the hub 80 and defines respective brush anchors 84*a* and 84*b* of the hub 80. The filaments 145 of each brush wire 138 extend through each respective one of the holes 96*a* and 96*b* in the hub 80 and are wrapped around the corresponding margin 146*a* and 146*b* of a respective one of the brush anchors 84*a* and 84*b*, such as using a conventional twisted knot 148, such that the portions of the filaments 145 of each wire 138 that extend radially outwardly of the outer peripheral hub edge 118 define a radially outwardly extending twisted wire tuft 139 of bristles 140 that are twisted in the manner depicted in FIG. 6A.

With continued reference to FIG. 6A, a preferred rotary radial brush 85 constructed with a hub 80 of the present invention is depicted in FIGS. 4-6A having 32 round or circular brush-anchoring holes 96*a* and 96*b* of a radially offset configuration each with a brush wire 138 having 30 bristles formed respectively of 15 elongate filaments 145 attached or anchored thereto using a conventional twisted knot 148 that twisted or otherwise secured about the corresponding margin 146*a* and 146*b* of respective brush anchor 84*a* and 84*b* with the 30 bristles 140 of each wire 138 extending radially outwardly beyond the outer peripheral edge 118 of the hub 80. Such a hub 80 having an increased number of holes 96*a* and 96*b*, namely 32 of the holes 96*a* and 96*b*, of a staggered radially offset configuration advantageously enables a portion of the longer bristles 140 and/or filaments 145 of the wires 138 extending from the radially inwardly offset holes 96*b* to be supported on either side by the brush anchor knot 148 and/or the bristles 140 or filaments 145 of the wire 138 extending from adjacent pairs of radially outwardly offset holes 96*a* thereby helping produce an abrasive wire face 144' that can be and preferably is larger in size or contact surface area. Such a hub 80 having an increased number of holes 96*a* and 96*b*, namely 32 holes 96*a* and 96*b*, of a staggered radially offset configuration advantageously enables the shorter wires 140 of the bundles 138 extending from the radially outwardly offset holes 96*a* to remain more tightly bundled together, preferably more tightly twisted together, maintaining a more tightly bundled and smaller abrasive wire face 144" that more aggressively removes material during brush rotation during surface finishing use and operation of the brush. Where this is the case, brush wire bundles 138 of the radially inwardly offset holes 96*b* equipped with longer brush wires 140 that produce a larger abrasive brush face 144' removes material over a wider swath or area of the surface being finished, and the brush wire bundles 138 of the radially outwardly offset holes 96*a* equipped with shorter brush wires 140 and a smaller abrasive brush face 144" removes material more aggressively advantageously producing a rotary brush in accordance with the present invention having an optimal blend of aggressive surface removal and surface area coverage. FIG. 6A shows that the abrasive wire face 144' of such longer brush wires 138 that extend radially outwardly from radially inwardly offset holes 96*b* have a larger abrasive wire face 144' than the abrasive wire face 144" of each shorter wire extending radially outwardly from radially outwardly offset holes 96*a*.

A rotary brush, e.g., brush 85, constructed in accordance with the present invention having such a hub 80 with 32 radially offset holes 96*a* and 96*b* each anchoring a radially outwardly brush wire 138 having about or exactly 30 elongate brush bristles 140 formed of about or exactly 15 brush wire filaments 145 advantageously outperforms the aforementioned prior art rotary brushes with the aforementioned conventional prior art hubs by removing more material per minute of abrasive surface finishing time, by possessing a greater brush life all while also having good to excellent cutting material removal per minute of rotary brush operation. Such a rotary brush, e.g., brush 85, constructed in accordance with the present invention having such a hub 80 with 32 radially offset holes 96*a* and 96*b* each anchoring a radially outwardly brush wire 138 having exactly 30 elongate brush bristles 140 formed of or from exactly 15 brush wire filaments 145 advantageously possesses an optimum combination of long life and abrasive material rate characteristics compared to the prior art.

TABLE 1 below provides comparative test data for (a) a rotary radial wire brush, e.g., brush 85 shown in FIG. 6A, of the claimed invention having a hub 80 with 32 holes 96*a* and 96*b* of an offset hole configuration having a brush wire 138 formed of 30 bristles, (b) applicant's prior art rotary radial wire brush with a hub with 30 holes of an offset configuration with each hole having a brush wire with 30 bristles, (c) applicant's prior art rotary radial wire brush with a hub with 32 holes of a circumferentially aligned slotted configuration with each hole having a brush wire with 30 bristles, (d) a competitor's prior art rotary radial wire brush with a hub with 32 holes of a circumferentially aligned slotted configuration with each hole having a brush wire with 28 bristles, and (e) applicant's prior art rotary radial wire brush with a hub with 30 holes of an offset configuration with each hole having a brush wire with 23 bristles.

TABLE 1

| Radial Brush Configuration | Removal (grams) @ 60% Wire Loss | Life (minutes) @ 60% Wire Loss | Cut (mg) g - ratio per minute @ 60% Wire Loss |
|---|---|---|---|
| Invention 32/30 32 Hole Offset w 30 Wires per Hole (INVENTION A) | 5.68 grams | 1,290.00 minutes | 109.44 mg/min. |
| Osborn 30/30 30 Hole Offset w 30 Wires per Hole (PRIOR ART B) | 4.27 grams | 980.00 minutes | 113.06 mg/min. |
| Osborn 32/30 32 Hole Slotted w 30 Wires per Hole (PRIOR ART C) | 4.58 grams | 880.00 minutes | 106.50 mg/min. |
| Competitor 32/28 32 Hole Slotted w 28 Wires per Hole (PRIOR ART D) | 5.51 grams | 726.67 minutes | 84.29 mg/min. |
| Osborn 30/23 30 Hole Offset w 23 Wires per Hole (PRIOR ART E) | 5.61 grams | 356.67 minutes | 141.82 mg/min. |

As shown in TABLE 1 above, a rotary steel wire brush, e.g., brush 85 of FIG. 6A, in accordance with the present invention made with a hub 80 with a 32-offset hole configuration and a conventional twisted knot wire 138 having at least 30 bristles 140 per hole 96*a* and 96*b* has the highest amount of material removal of 5.68 grams before reaching 60% brush wire loss, has a very good rate of abrasive material removal of 109.44 milligrams per minute of rotary brush operation at 60% brush wire loss, and possesses the longest brush life of about 21.5 hours before reaching 60% brush wire loss. In fact, a rotary steel wire brush in accordance with the present invention made with a hub 80 with a 32-offset hole configuration and at least 30 bristles per hole 96*a* and 96*b* possesses at least 30% greater brush life than the next longest-lived prior art brush, PRIOR ART B, removes at least 30% more material before reaching 60% wire loss than the next longest-lived prior art brush, PRIOR ART B, while having nearly the same material removal rate at 60% wire loss as the next longest lived prior art brush, PRIOR ART B.

While a rotary radial wire brush constructed with such a hub 80 having a 32 hole offset hole configuration with each twisted knot wire bundle 138 being formed with at least 29 bristles 140 per wire 138 and preferably having at least 30 bristles per wire 138 radially extending from each one of its holes 96*a* and 96*b* has an optimal combination of long brush life and material removal, a rotary radial wire brush constructed in accordance with the present invention can be and preferably is further configured or additionally constructed with one or more of the additional novel and inventive features and improvements discussed in more detail below.

With reference once again to the cross section of hub 80 shown in FIG. 5, such a hub 80 with at least one and preferably both ends, openings or mouths of each brush-anchoring hole 96 being of diametrically enlarged construction having at least one beveled outer edge 130 formed by a chamfer 132 of each hole 96*a* and 96*b* that defines or serves as a brush wire and/or filament supporting contact surface area increasing stress relief 128 advantageously increases rotary brush life by better and more uniformly supporting the brush wire filaments 145 of each wire 138 anchored to the hub 80 as well as the bristles 145 of each wire 138 during abrasive material removal during surface finishing. While only one of the edges 134 of each hole 96*a* and 96*b* is so configured in the hub 80 depicted in FIGS. 4 and 5, a preferred embodiment of such a hub 80 can be configured with the other edge 136 of each hole 96*a* and 96*b* also being configured with such a brush wire filament supporting contact surface area increasing stress relief 128. While each such stress relief 128 can be in the form of a diametrically hole enlarging bevel 130 along one or both hole edges 134 or 136, such as provided by a chamfer 132 of one or both hole edges 134, other stress relieving configurations that also increases the surface area of contact with the filaments 145 and/or bristles 140 of the brush wire 138 and/or which also diametrically enlarge a mouth or entranceway of each hole 96*a* and 96*b* are contemplated and discussed in more detail below.

With continued reference to FIG. 5, such a bevel 130 formed by a chamfer 132 of one or both outer edges 134 or 136 of each hole 96*a* and 96*b* of hub 80 preferably not only diametrically enlarges a portion of each hole 96*a* and 96*b* at or near the mouth or entranceway of each hole 96*a* and 96*b*, but also reduces and preferably substantially eliminates sharp corners and/or rough portions along substantially the entire periphery of one or both hole edges 134 and/or 136 of each hole 96*a* and 96*b*. Reduction and preferably substantial elimination of sharp corners or rough portions at or along one or both edges 134 and 136 of each hole 96*a* and 96*b* of the hub 80 advantageously reduces brush wire wear and/or individual filament and/or bristle fracture during rotary brush surface finishing operation using a rotary brush, e.g., brush 85, of the present invention made therewith. In addition to the at least one beveled hole edge 134 of each hole 96*a* and 96*b* reducing brush wire, filament and/or bristle stress, wear and breakage during abrasive surface finishing use and operation, the at least one beveled hole edge 134 advantageously also diametrically enlarges the hole 96*a* and 96*b* along each edge 134 thereby enabling each brush wire 138 to be formed of more filaments 145 and bristles 140 which preferably can be and also have a larger width or diameter as compared to any of the aforementioned conventional prior art radial brushes made with the aforementioned conventional prior art hub having holes of the same diameter that lack any such stress relieving diametrically enlarged hole construction.

A rotary radial brush of the present invention made with such a hub 80 having holes 96*a* and 96*b* with such a diametrically enlarged brush wire stress reducing hole edge or hole corner configuration being able to accommodate brush wires 138 having more filaments 145 or bristles 140 in each brush wire 138 extending radially outwardly from each hole 96*a* and 96*b* advantageously has a relatively high and preferably greater rate of material removal for a given period of time of brush abrasive surface finishing operation as compared to the aforementioned conventional prior art brushes made with convention prior art hubs having brush wires made with a lesser number of filaments or bristles per wire. Such a rotary radial brush of the invention made with such a hub 80 constructed in accordance with the present invention having such holes 96*a* and 96*b* of diametrically enlarged brush wire stress reducing hole edge or hole corner configuration that accommodates a greater number of filaments 145 and bristles 140 in each wire 138 advantageously has a greater rate of material removal during surface finishing operation as compared to conventional prior art brushes made with such convention prior art hubs having holes of the same diameter that are limited to brush wires with a lesser number of filaments or bristles of the same filament or bristle diameter per brush wire. Such a rotary radial brush made with such a hub 80 having holes 96*a* and 96*b* of such a diametrically enlarged brush wire stress reducing hole edge or hole entrance configuration that accommodates brush wires 138 each having a greater number of brush filaments 145 and bristles 140 not only achieves a higher rate of material removal but advantageously maintains a higher rate of material removal for a longer time period as compared to conventional prior art brushes made with convention prior art hubs having brush wires which have or are limited to a lesser number of filaments or bristles per wire. Finally, such a rotary radial brush made with such a hub 80 having holes 96*a* and 96*b* of such a diametrically enlarged brush wire stress reducing hole edge or hole entrance configuration that advantageously accommodates brush wires 138 having a greater number of brush wire bristles 140 and brush wire filaments 145 in each wire 138 not only achieves a higher rate of material removal and maintains a higher rate of material removal for a longer time period as compared to conventional prior art brushes made with convention prior art hubs having brush wires which have or are limited to a lesser number of bristles or filaments per brush wire, but which also produces a rotary radial brush of the present that is longer lasting and which has a longer life.

If desired, each edge 134 and/or 136 of each hole 96*a* and 96*b* can be smoothed or rounded even more than the beveled or chamfered top or upper edge 134 of each hole 96*a* and 96*b* of the cross section of the hub 80 shown in FIG. 5 to even further extend brush life by further reducing brush wire, bristle, and filament breakage or fracturing due to filaments 145 and/or bristles 140 rubbing on or along corner edge(s) 134 and/or 136 during surface finishing or material removal during rotary brush operation. Although not shown, at least one of the top and bottom hole edges 134 and/or 136 can be rounded, such as by a metal finishing operation, an abrasive material removal operation, an annealing operation, or another type of procedure, to substantially completely eliminate any sharp edges or sharp corners, preferably producing a substantially smooth rounded bend along which each filament 145 and bristle 140 of each brush wire 138 contacts as a result of being twist knot anchored. In a preferred method and implementation of such a rounded or smoothed hole edge or hole corner configuration, smoothing or rounding of the hole edge or corner 134 and/or 136 produces a rounded and smooth edge or corner with an increased radius of curvature that advantageously reduces the bend and corresponding resultant stress each filament 145 and/or bristle 140 of the brush wire 138 thereat. Such a substantially smooth and rounded hole corner or edge construction advantageously not only reduces brush wire, brush wire filament and/or brush wire bristle stress during surface finishing operation, but it also reduces rubbing of filaments 145 of the wire 138 in contact with such smoothed rounded hole corners or edges during abrasive material removal thereby advantageously extending brush wire life.

Such a substantially smooth and rounded hole corner or edge construction advantageously also facilitates the use of brush wires 138 extending radially from each hole 96*a* and 96*b* that have a greater number of filaments 145 and bristles 140 per wire 138 for a given hole diameter. Use of a greater number of brush wire filaments 145 and hence bristles 140 per wire 138 not only advantageously increases the rate of material removal during rotary radial brush operation, but also advantageously extends rotary brush life and can and preferably also does extend the length of time of increased rate of material removal. Such a substantially smooth and rounded hole corner or edge construction not only enables use of brush wires 138 having a greater number of brush wire filaments 145 and bristles 140 per wire 138 for a given hole diameter, but advantageously enables such a rotary brush to be equipped with at least a plurality of brush wires 138 having filaments 145 and/or bristles 140 of a larger diameter. Use of a greater number of brush wire filaments 145 and brush bristles 140 per wire 138 where at least a plurality, preferably at least a plurality of pairs, i.e. at least three, of the filaments 145 and/or bristles 140 have a larger diameter can and preferably does further increase the rate of material removal, can and preferably does further increase the length of time the increased material removal rate can be achieved and maintained, and can and preferably also does increase rotary brush life. In a preferred embodiment of a rotary brush made with such a hub 80 with such a smoothed and rounded brush anchoring hole construction, each one of the 32 radially staggered or offset holes 96*a* and 96*b* accommodates a brush wire 138 having a greater number of brush wire filaments 145 and bristles 140 per wire 138 for a given hub and hole diameter, all of which preferably possess a larger diameter than previously used in brush wires of conventional prior art rotary brushes of the same given hub and hole diameter. Use of a greater number of brush wire filaments 145 and bristles 140 per wire 138 where each wire 138 has a larger wire width or diameter and where each filament 145 and bristle also has a larger width or diameter not only increases the rate of material removal even more during rotary radial brush operation, but also can and preferably does extend the length of time of the increased rate of material removal while preferably even further extending brush life. Such a rotary brush of the invention having such a hub 80 constructed in accordance with the present invention with 32 staggered or radially offset holes 96*a* and 96*b* of having such substantially rounded and/or substantially smooth top and/or bottom edges 134 and/or 136 accommodates brush wires 138 each made with a greater number of filaments 145 and bristles 140, preferably about or exactly 30 brush bristles 140 per wire 138, and which have a greater brush wire diameter, a greater brush wire filament diameter and a greater brush bristle diameter, not only possesses at least a plurality of such advantages or benefits discussed hereinabove but advantageously does so while enabling an operator of the rotary brush to urge the brush bristles 140 of the brush wires 138 of the brush against the surface to be abrasively finished with a greater amount of force or pressure such as to facilitate greater or deeper material removal.

A rotary radial wire brush constructed with hub 80 in accordance with the present invention having such brush wire stress-relieved wire holes 96*a* and 96*b* configured with such stress relieved hole edges 134 and/or 136 can and preferably does possess an even longer brush life than that listed above in Table 1 for invention A. Such a rotary radial brush made with a hub 80 configured with such a stress-relieved brush anchoring hole construction can and preferably also does have an even greater material removal rate than that listed above in Table 1 for invention A.

Where a rotary radial wire brush of the present invention is constructed with a hub 80 having holes 96*a* and 96*b* configured with one or both hole edges 134 and/or 136 being of a diametrically enlarged construction, e.g., beveled, countersunk, diametrically tapered, and/or smoothed, rounded and/or polished, e.g., stress relieved construction, thereby facilitating accommodation of brush wires 138 having a greater number of filaments 145 or bristles 140 per wire 138 of at least 29 bristles 140 per wire 138 (i.e., at least 29 bristles 140 per hole 96*a* and 96*b*), which is about 30 bristles per wire 138 (i.e., about 30 bristles±1 bristle(s) per hole 96*a* and 96*b*) or about 15 filaments 145 per wire 138 (i.e., about 15 filaments±1 filament(s) per hole 96*a* and 96*b*), and which preferably is exactly 30 bristles 140 per wire 138 (i.e., 30 bristles 140 per hole 96*a* and 96*b*) and exactly 15 filaments 145 per wire 138 (i.e., 15 filaments 140 per hole 96*a* and 96*b*) advantageously can and preferably also does perform at least as well or better than the rotary radial wire brush of invention A in Table 1. In one preferred embodiment, the brush has a hub 80 with holes 96*a* and 96*b* having one or both hole edges 134 and/or 136 being of a diametrically enlarged construction, e.g., beveled, countersunk, diametrically tapered, and/or smoothed, rounded and polished, enabling wire brush wires 138 with greater than 30 bristles 140 per wire 138 per hole 96*a* and 96*b* to be used with such a brush of the invention performing better than the brush of invention A in Table 1 above in at least one performance test category listed in Table 1. In one such preferred embodiment, such a brush of the invention having brush wires 138 with more than 30 bristles 140 and/or more than 15 filaments 145 per wire 138 per hole 96*a* and 96*b* of hub 80 of offset hole configuration preferably performs better than the brush of invention A in at least a plurality of the performance categories listed above in Table 1. In one such preferred embodiment, each wire 138 of such a brush of the present invention has 31 or 32 bristles per wire 138 and/or has at least 16 filaments per wire 138 producing a brush of the invention that performs at least as well as the brush of invention A with respect to at least one and preferably at least a plurality of the performance test categories listed in Table 1

FIG. 6B and FIG. 16 illustrate another preferred embodiment of an abrasive rotary brush 210 constructed in accordance with the present invention that employs a center disc hub 212 with radially outermost brush mounts 214*a* that are larger than radially innermost brush mounts 214*b* from which brush wires 216*a*, 216*b* radially outwardly extend that are formed of at least a plurality of pairs of brush wire filaments 145 that are both twisted and braided producing brush wires 216*a*, 216*b* having narrow tufts 139 with bristle tips 142 constrained to define relatively small sized abrasive contacting working faces 144 that more efficiently abrasively remove material for a longer period of time resulting in increased brush operating life. Such an abrasive rotary brush 210 of the present invention has operating characteristics, parameters and life at least as good as that of Invention A in Table 1 above.

With continued reference to FIG. 6B, the center disc hub 212 is similar in construction to the hub 80 shown in FIGS. 4-6A discussed above but differs in that its radially outermost brush mounts 214*a* are larger than its radially innermost brush mounts 214*b*. As with hub 80, radially outermost brush mounts 214*a* are uniformly circumferentially spaced apart and are all spaced the same radial distance from the center of the hub 212 and radially innermost brush mounts 214*b* are uniformly circumferentially spaced apart and are all spaced the same radial distance from the center of the hub 212 that is less than the radial distance the radially outermost brush mounts 214*a* are spaced from the hub center.

In the preferred center hub embodiment depicted in FIG. 6B, each radially outermost brush mount 214*a* is defined by an aperture 218*a* that preferably is an opening 220*a*, more preferably a round or circular opening 220*a*, which is larger than the aperture 218*b* that preferably is an opening, more preferably also a round or circular opening 220*b*, which defines radially innermost brush mount 214*b*. In the preferred hub embodiment shown in FIG. 6B, each radially outermost opening 220*a* preferably radially overlaps the radially innermost opening 220*b* circumferentially staggered to either or both sides of opening 220*a* thereby enabling the twisted knot 224*a* used to anchor the wire 216*a* to the hub 212 to more freely pivot or move during abrasive material removal. Imparting the ability of the twisted knot 224*a* of the wires 216*a* that extend farthest radially outwardly from the hub 212 and brush 210 helps ensure greater surface area of contact between the working face 144 and surface being abrasively treated. It also causes the working face 144 of each such brush wire 216*a* to less aggressively abrade the surface being treated thereby treating the surface in a manner that provides or imparts a better surface finish than such a brush having such aggressive material removal rates would ordinarily possess.

Each radially outermost opening 220*a* of brush mount 214*a* is at least 50% larger in size, preferably at least 50% larger in diameter, than radially innermost opening 220*b* of brush mount 214*b*. In the preferred embodiment shown in FIG. 6B, each radially outermost opening 220*a* of brush mount 214*a* is about at least twice as large in size, preferably is about at least twice as larger in diameter, than radially innermost opening 220*b* of brush mount 214*b*.

Each brush wire 216*b* extending radially outwardly from smaller radially innermost opening 220*b* of radially innermost brush mount 214*b* has a twisted knot 224*b* that is greater in length than the twisted knot 224*a* of each brush wire 216*a* that extends radially outwardly from radially outermost opening 220*a* of radially outermost brush mount 214*a* thereby imparting greater stiffness to each brush wire 216*b*. Such greater stiffness imparted to each such brush wire 216*b* advantageously causes it to more aggressively abrade the surface being treated during rotation of brush 210 by a rotary power tool (not shown). The twisted knot 224*b* of brush wire 216*b* anchored to radially innermost opening 220*b* of radially innermost brush mount 214*b* is at least 50% greater in length than the length of the twisted knot 224*a* of brush wire 216*a* anchored to radially outermost opening 220*a* of radially outermost brush mount 214*a* thereby producing brush wires 216*b* having at least 10% greater stiffness than brush wires 216*a*. In the preferred embodiment shown in FIG. 6B, the twisted knot 224*b* of brush wire 216*b* anchored to radially innermost opening 220*b* of radially innermost brush mount 214*b* is at least twice as great in length than the length of the twisted knot 224*a* of brush wire 216*a* anchored to radially outermost opening 220*a* of radially outermost brush mount 214*a* thereby producing brush wires 216*b* having at least 12% greater stiffness than brush wires 216*a*. With continued reference to FIG. 6B, the twisted knot 224*b* of brush wire 216*b* anchored to radially innermost opening 220*b* of radially innermost brush mount 214*b* is at least two and half times as great in length than the length of the twisted knot 224*a* of brush wire 216*a* anchored to radially outermost opening 220*a* of radially outermost brush mount 214*a* thereby producing brush wires 216*b* having at least 15% greater stiffness than brush wires 216*a*.

The result is a brush 210 constructed in accordance with the present invention having more flexible brush wires 216*a* anchored by shorter twist knots 224*a* to radially outermost openings 220*a* of radially outermost brush mounts 214*a* that extend radially outwardly a greater distance, d, than the less flexible more aggressive brush wires 216*b* anchored by longer twist knots 224*b* to radially innermost openings 220*b* of radially innermost brush mounts 214*b* producing a brush 210 of the present invention of hybrid construction. Such hybrid construction comes from the fact that its radially longer brush wires 216*a* are more flexible and less aggressive thereby advantageously imparting a better surface finish to the surface being abrasively treated while the radially shorter brush wires 216*b* are more stiff and aggressive advantageously increasing material removal rates. FIG. 16 depicts such a brush 210 of the present invention in its fully assembled form.

Figure 7:
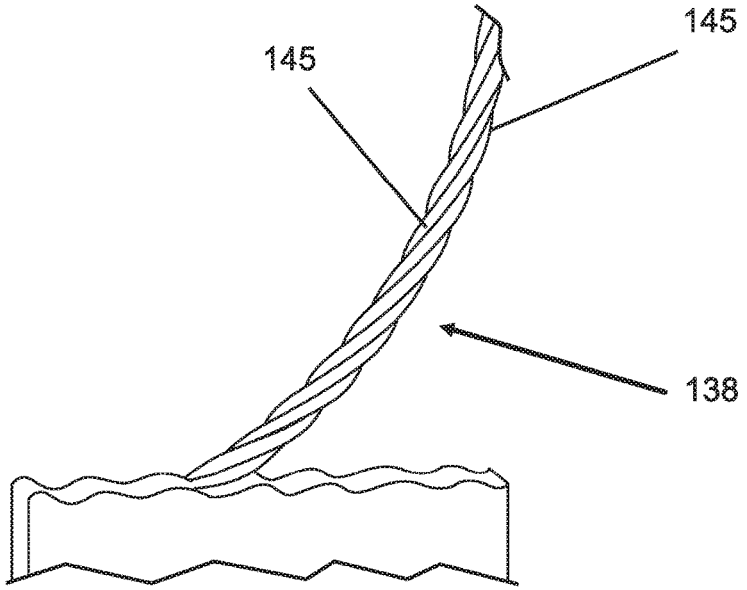
FIG. 7 is a fragmentary elevation view of an elongate abrasive end or tuft portion of an exemplary brush wire suitable for use with a rotary radial wire brush of the present invention made with the 32-hole offset hole hub depicted in FIGS. 4-6B.

With reference to FIGS. 7-10, a rotary brush, e.g., brush 85, constructed in accordance with the present invention having such a hub 80 with 32 radially offset brush-seating holes 96*a* and 96*b* is not only well suited for use with a conventional wire 138 like the wire 138 generically or schematically depicted in FIG. 7 that is composed of at least 30 bristles 140 formed from at least 15 filaments 145 that make up the wire 138. Such a brush wire 138 of multifilament construction that is formed of at least about 15 filaments 145 but typically not more than about 20 filaments 145 producing a rotary brush of the invention having such a 32-hole radially offset hole hub 80 with such multifilament brush wires 138 anchored thereto extending radially from each hole 96*a* and 96*b* that preferably possesses long life and excellent abrasive material removal characteristics as indicated by the test results of INVENTION A in TABLE 1 above. While each one of the brush wires 138 of the embodiment of the brush 85 depicted in FIG. 6A is of twisted wire construction where the filaments 145 of each brush wire 138 are looped through a corresponding one of the holes 96*a* and 96*b* and overlapped before being twisted around respective margin 146*a* and 146*b* of corresponding brush anchor 84*a* and 84*b* producing a wire 138 that can be of standard twist knot construction but which preferably is of cable twist knot construction and which more preferably is of stringer bead twisted knot construction. In one preferred embodiment, such a brush, e.g., brush 85, having wires 138 of one of a standard twisted knot or cable twisted knot configuration.

Figure 8:
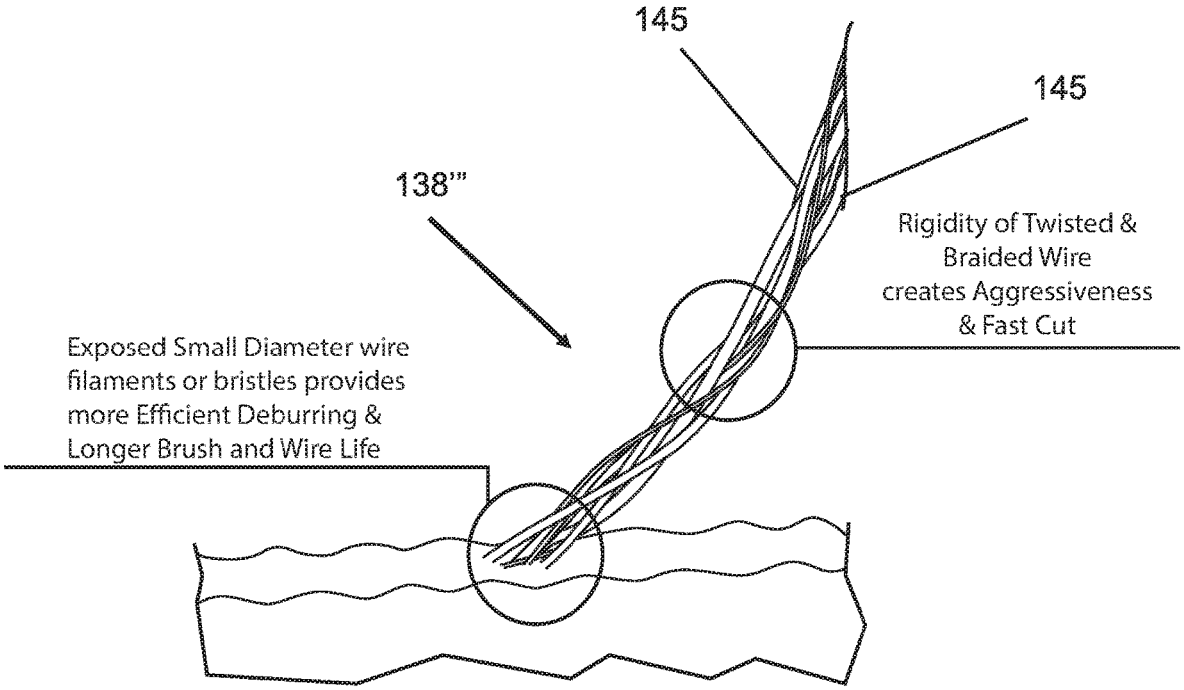
FIG. 8 is a fragmentary elevation view of an elongate portion of an embodiment of an improved brush wire that includes an abrasive face at the tip or end thereof that can be used with a rotary radial wire brush of the present invention made with the 32-hole offset-hole hub depicted in FIGS. 4-6B.

While a rotary radial wire brush, e.g., wheel wire brush or power brush, of the present invention made with such a 32-hole radial offset hole configured hub 80 equipped with a brush wire 138 extending radially from each hole 96*a* and 96*b* having at least 30 bristles 140 per wire 138 formed of or from at least 15 elongate filaments 15 per wire 138 that are longer than bristles 140 has outstanding performance as evidenced by the test results of INVENTION A in Table 1, such a brush made with such a hub 80 constructed in accordance with the present invention can employ novel and inventive twisted brush wires 138' and/or braided brush wires 138" in accordance with that discussed in more detail below and shown in one or more of FIGS. 8-10.

In one preferred embodiment, a rotary radial brush constructed with a 32-hole radially offset configured hub 80 is equipped with at least one of a twisted brush wire 138', such as depicted in FIG. 9, and a braided brush wire 138", such as depicted in FIG. 10, seated in at least a plurality of pairs of the holes 96*a* and 96*b* and anchored via a twisted knot 148 or the like to brush anchor(s) 84*a* and 84*b*. In another preferred embodiment, the brush wire 138''' is a hybrid twisted and braided brush wire 138''' like that depicted in FIG. 8 that is of both twisted wire construction and braided wire construction as discussed in more detail below. Such a hybrid wire 138''' preferably has at least a plurality of pairs of filaments 145 that are both twisted and braided producing a wire 138''' well suited for substitution for wire 138 in the brush 80 of the present invention shown in FIGS. 4-6A and even the brush 210 shown in FIGS. 6B and 16. The use of such an improved twisted and/or braided brush wire of the type shown in FIGS. 7-10 advantageously further improves the performance characteristics of a brush of the invention made such wires 138', 138" and/or 138''' over that of the brush of INVENTION 1.

In a preferred embodiment, the hub 80 of a rotary radial wire brush of the invention has twisted brush wire 138', braided brush wire 138" or hybrid twisted and braided wire 138''' extending radially outwardly from the holes 96*a* and 96*b* radially beyond the outer peripheral hub edge 118. In another such preferred embodiment, the hub 80 of a rotary radial wire brush of the invention has at least a plurality of pairs of holes 96*a* and/or 96*b* with twisted brush wires 138' extending radially outwardly therefrom, has at least a plurality of pairs of holes 96*a* and/or 96*b* with braided brush wires 138" extending radially outwardly therefrom, and/or has at least a plurality of pairs of holes 96*a* and/or 96*b* with twisted and braided brush wires 138''' extending radially outwardly therefrom with each one of the holes 96*a* and 96*b* having at least one of the twisted wires 138', at least one of the braided wires 138" and/or at least one of the hybrid twisted and braided wires 138'''.

In one preferred embodiment, the hub 80 of one such a brush of the invention has either twisted brush wires 138' or braided brush wires 138" extending radially outwardly from each one of the set 98 of radially outermost disposed holes 96*a* and which are anchored via a twisted knot 148 or the like to corresponding brush anchors 84*a*, and has the opposite one of either braided brush wires 138" or twisted brush wires 138' extending radially outwardly from each one of the set 100 of radially innermost disposed holes 96*b* and which are anchored via a twisted knot 148 or the like to corresponding brush anchors 84*b*. In one such preferred embodiment, the hub 80 of one such brush of the invention has twisted brush wires 138' extending radially outwardly from each one of the set 98 of radially outermost disposed holes 96*a* and which are anchored via a twisted knot 148 or the like to corresponding brush anchors 84*a*, and has braided brush wires 138" extending radially outwardly from each one of the set 100 of radially innermost disposed holes 96*b* and which are anchored via a twisted knot 148 or the like to corresponding brush anchors 84*b*. In another such preferred embodiment, the hub 80 of another such brush of the invention has braided brush wires 138" extending radially outwardly from each one of the set 98 of radially outermost disposed holes 96*a* and which are anchored via a twisted knot 148 or the like to corresponding brush anchors 84*a*, and has twisted brush wires 138' extending radially outwardly from each one of the set 100 of radially innermost disposed holes 96*b* and which are anchored via a twisted knot 148 or the like to corresponding brush anchors 84*b*.

The brush wire 138' of the present invention shown in FIG. 9 can also be of a twisted knot construction but differs from that of convention standard twisted knot wire construction, cable twisted knot wire construction or stringer bead twisted knot wire construction in a manner that makes it more durable, maintains a smaller abrasive wire face over a longer period of time or brush wear, keeps the filaments or bristles of each wire constrained preventing them from splaying thereby helping to maintain a smaller abrasive wire face for a longer period of time, and lasts longer producing a brush that has a longer life. One preferred embodiment of such a twisted brush wire 138' depicted in FIG. 9 has an outer support layer 152 formed of at least a plurality of elongate outer brush wire filament or bristle supporting bindings 154, preferably a plurality of pairs, i.e., at least three, bindings 154, extending substantially the length of the wire 138' and which are twisted about a longitudinally extending twist axis disposed at or along a centerline of the wire 138' in one direction relative to the twist axis around an inner core 156 of the wire 138' formed of the brush filaments 145 and/or bristles 140. Each brush wire core support binding 154 is elongate and of generally circular or rectangular, e.g., square, cross-section and preferably is formed of one or more filaments like or substantially the same as the filaments 145 or bristles 140 of the brush wire inner core 156. As also is shown in FIG. 9, the bindings 154 are arranged to form an elongate tubular brush wire supporting latticework 160 that can and preferably does extend at least the length of the tuft portion of the wire 138' preferably to or adjacent the abrasive brush wire face 144 formed by the filament or bristle tips 142 of the wire 138'.

In a preferred embodiment, each one of the bindings 154 is formed of an elongate wire core strengthening ribbon 158 with the brush wire core supporting latticework 160 formed of a plurality, preferably a plurality of pairs, of the ribbons 158 arranged relative to one another in a manner that produces such a latticework 160 that wraps around and is substantially coaxial with the brush wire core 156. Each ribbon 158 can be and preferably is formed of at least a plurality, preferably at least a plurality of pairs, of elongate filaments or the like which are braided, woven or otherwise arranged or formed into an elongate generally flat ribbon 158 like that shown in FIG. 9 that each can and preferably does helically wrap around the exterior of the core 156. Where each brush wire core supporting binding 154 is a ribbon 158, at least a plurality, preferably at least a plurality of pairs, of the ribbons 158 can be helically wrapped around the core 156 with a flat side of each ribbon 158 facing towards or disposed against the outer surface of the core 156 in a manner depicted in FIG. 9 with the ribbons 158 preferably twisted with and/or crossing one another in the manner also shown in FIG. 9 producing brush wire core enshrouding latticework 160.

Where the brush wire core support bindings 154 are of generally circular or rectangular, e.g., square, cross section, bindings 154 can be formed of any one of a number of the same relatively strong, tough, flexible and resilient brush wire materials as the filaments 145, such as steel, including medium and high carbon steel, stainless steel, or the like. While bindings 154 of such generally circular or rectangular construction can have the same or a smaller width or diameter as that of the filaments 145 and/or bristles 140 of the inner core 156, the bindings 154 preferably have a width or diameter greater than that of the filaments 145 or bristles 140 of the inner core 156, such where desired to provide greater structural support thereto. Where the bindings 154 are formed of ribbons 158, each one of the ribbons 158 can also be of metallic construction such as by being made of woven or braided steel or aluminum construction. Where ribbons 158 are employed, the ribbons 158 can and preferably do have a thickness less than the diameter or width of the filaments 145 and/or bristles 140 of the inner core 156.

The inner core 156 of the wire 138' is formed of at least a plurality, preferably at least a plurality of pairs, i.e., at least three, elongate brush wire filaments 145, which preferably also define or form abrasive material removing bristles 140, which can be substantially straight and generally parallel with one another such as by being arranged side-by-side and/or in contact with one another substantially the length of the core 156 covered by bindings 154, ribbons 158, and/or latticework 160. The filaments 145 or bristles 140 are preferably of metallic construction, such as by being made of a steel, such as a medium or high carbon steel, stainless steel, or another steel or metal alloy and can be coated or encapsulated, such as with or by an elastomer, plastic, epoxy, a resin, or the like, if desired.

In one embodiment, the core 156 is formed of elongate bristles 140 or filaments 145 twisted together at least along the portion of the core 156 extending radially outwardly from the hub 80 forming a single elongate twisted strand preferably having a plurality, more preferably a plurality of pairs, of twists therealong with the twist direction being the same as or opposite that of the direction of twist of bindings 154 and/or the same as or opposite that of the direction of helical wrap of ribbons 158. In another embodiment, bristles 140 and/or filaments 145 of the core 156 are arranged into at least a plurality, preferably at least a plurality of pairs, of strands with each strand formed of at least a plurality, preferably at least a plurality of pairs, of bristles or filaments twisted at least a plurality, preferably at least a plurality of times along the length of each strand. In still another embodiment, bristles 140 and/or filaments 145 of the core 156 can be formed into a plurality, preferably a plurality of pairs, of strands each formed of a plurality, preferably a plurality of pairs, of bristles 140 and/or filaments 145 braided together. Where core 156 is formed of multiple strands, at least a plurality, preferably at least a plurality of pairs of the strands are twisted and/or braided together along their length preferably twisted at least a plurality, preferably at least a plurality of pairs, of times where twisted.

Where bristles 140, filaments 145 or strands are twisted, including as described elsewhere herein, they preferably are twisted at least a plurality, preferably at least a plurality of times along their length, and are twisted along substantially the length of the wire 138', core 156 or at least the portion of the core 156 forming the tuft of the brush wire 138' and/or extending radially of or from hub 80. Where twisted, the filaments 145 and/or bristles 140 of each strand preferably are twisted together at least a plurality, preferably at least a plurality of pairs, of times along the length of the strand, wire 138' or tuft with the filaments 145 and/or bristles 140 of a preferred strand twisted at least a plurality, preferably at least a plurality of pairs, of times per inch or centimeter of length of the wire 138, filaments 145, bristles 140, strand, or tuft.

The inner core 156 of such a wire 138' coaxially supported by latticework 160 is formed of at least 28 elongate bristles 140 and/or 28 elongate filaments 145. Where the wire 138' and/or core 156 of the wire 138' is attached to hub 80 by a twisted knot 148, the core 156 preferably is formed of at least 14 elongate filaments 145 which overlap, can be twisted, and/or braided forming at least 28 bristles 140. In another embodiment, the core 156 is formed of at least 29 elongate bristles and/or 29 elongate filaments 145 each of which extends at or adjacent to the brush wire face 142 at the head or free end of the wire 138'. In still another embodiment, the core 156 is formed of at least 30 elongate bristles and/or 30 elongate filaments 145 each of which extends at or adjacent to the brush wire face 142 at the head or free end of the wire 138'. Where the wire 138' and/or core 156 of the wire 138' is attached to hub 80 by a twisted knot 148, the core 156 preferably is formed of at least 15 elongate filaments 145 which overlap, can be twisted, and/or braided forming at least 30 bristles 140 that each extend to or adjacent the face 142 at the head or free end of the wire 138'. In one such preferred embodiment of such a binding, ribbon or latticework supported wire 138' of the present invention, the core 156 has exactly 30 bristles 140 and/or exactly 30 filaments 145 with one such preferred core 156 having exactly 15 filaments 145 and exactly 30 bristles 140 where the filaments 145 are overlapped such as where the wire 138' or core 156 is of twisted knot construction.

One preferred rotary radial wire brush of the invention has a hub 80 with 32 holes 96*a* and 96*b* of offset configuration is equipped with 32 wires 138' of the configuration depicted in FIG. 9, with each wire having such an outer bristle supporting latticework 160 wrapped around, enshrouding, or covering the inner wire core 156 that is formed of between 29 and 35 bristles 140 and/or filaments 145, preferably is composed of between 29 and 32 bristles 140 and/or filaments 145, more preferably has at least about 30 bristles 140 and/or filaments 145, and even more preferably has exactly 30 bristles and/or filaments 145. Where each brush wire 138' has such a multi-bristle or multifilament inner wire core 138' of twisted knot construction, each wire 138' has an inner core 156 formed of at least 14 filaments 145 and at least 28 bristles 140, preferably is formed of at least 15 filaments 145 and at least 30 bristles 140, and more preferably is formed of exactly 15 filaments 145 and exactly 30 bristles 140.

The bindings 154, including where formed of ribbons 158, twisted, wrapped, braided and/or woven about the inner core 156 of brush wire bristles 140 and/or filaments 145 provide greater structural support to the filaments 145 and bristles 140 defined by the filaments 140 producing a stronger, stiffer brush wire 138' of the invention holding them together better during abrasive material removal thereby advantageously imparting to a rotary radial wire brush, e.g., wheel brush or power brush, of the present invention made with such wires 138' significantly improved abrasive material removal characteristics, preferably doing so without a reduction in brush wire life. Such a brush wire 138' advantageously increases the aggressiveness and preferably also increases the speed of the cut or area of the surface being abrasively finished or treated along which surface material is abrasively removed thereby during rotary brush operation.

The resultant twisted binding or twisted ribbon brush wire supporting latticework 160 possesses flexibility which also helps dampen and/or absorb shock loads encountered by the bristles 140 or filaments 145 of the wire 138' during abrasive material removal when contacting surfaces being treated or finished that are rougher, have upraised projections, or otherwise result in the wire 138' impacting thereagainst during brush rotation during abrasive material removal during surface finishing or treatment therewith. In doing so, the tips of the wire advantageously more continuously remain in contact with the surface being finished or treatment thereby producing a brush of the invention equipped with such wires 138' that abrasively remove a greater amount of surface material during a given amount of time or brush wear while advantageously producing a more uniform surface finish preferably while maintaining, if not increasing, brush life. In addition, by the outer layer of twisted bindings or ribbons providing support to the core filaments or bristles substantially along their length including to adjacent or at the tips of the abrasive face, filament or bristle breakage is reduced thereby increasing wire and brush life.

The brush wire 138" of the present invention shown in FIG. 10 is of braided construction having an outer layer 162 formed of at least a plurality of elongate flexible outer brush wire filament or bristle supporting bindings 154', preferably a plurality of pairs, i.e., at least three, bindings 154', extending substantially the length of the wire 138" which are braided together forming an elongate tubular flexible braided or woven outer wire sleeve 164 that substantially covers or encloses the filaments 145 and/or bristles 140 of the inner core 156 of the wire 138" constraining and structurally supporting the filaments 145 and/or bristles 140 within the sleeve 164. Each brush wire core support binding 154' is elongate and of generally circular or rectangular, e.g., square, cross-section and preferably is formed of one or more filaments like or substantially the same as the filaments 145 or bristles 140 of the brush wire inner core 154'. In the preferred embodiment of the wire 138" shown in FIG. 10, the brush wire core constraining and supporting sleeve 164 is formed of at least a plurality, preferably at least a plurality of pairs, of elongate flexible and generally flat or rectangular cross-sectioned bindings 154' each of which preferably is a generally flat, elongate and flexible band 166 of generally rectangular cross-section.

While the filaments 145 and/or bristles 140 of the core 156 of a brush wire 138" constructed in accordance with the present invention can be substantially straight and generally parallel lying side by side one another, including in contact with one another, filaments 145 and/or bristles 140 of the core 156 of another embodiment of the wire 138" can also be of a twisted or braided configuration if desired. Where filaments 145 and/or bristles 140 are twisted, at least a plurality or plurality of pairs of the filaments 145 and/or bristles 140 of the core 156 are twisted forming at least a plurality of elongate flexible strands, such as in the manner described hereinabove with respect to the twisted wire 138' of FIG. 9. Where two or more filaments 145 and/or bristles 140 of core 156 are twisted together forming two or more elongate flexible strands within the sleeve 164, a plurality or more of the strands can instead be twisted or braided together. In one preferred embodiment of the wire 138", all of the filaments 145 and/or bristles 140 are twisted together such that the wire core 156 is formed of a single elongate flexible strand of twisted filaments 145 and/or bristles 140 which is covered or enclosed in or by the elongate tubular core supporting and stiffening sleeve 164. In another preferred embodiment of the wire 138", filaments 145 and/or bristles 140 of core 156 are twisted together forming at least a plurality, preferably at least a plurality of pairs, of twisted filament or twisted bristle strands which are in turn twisted together forming a wire core 156 of multiple twisted strand construction. In still another preferred embodiment of the wire 138", at least a plurality, preferably at least a plurality of pairs, of the filaments 145 and/or bristles 140 of the brush wire core 156 are braided together forming at least a plurality, preferably at least a plurality of pairs, of braided filament or braided bristle strands which are in turn braided together forming a wire core 156 of braided strand construction. In a further preferred embodiment of the wire 138", at least a plurality, preferably at least a plurality of pairs, of the filaments 145 and/or bristles 140 of the brush wire core 156 are braided together forming at least a plurality, preferably at least a plurality of pairs, of braided filament or braided bristle strands which are in turn twisted together along the longitudinal center axis, e.g., twist axis, of the brush wire 138" thereby forming a wire core 156 of braided filament or braided bristle twisted strand construction. In still another preferred embodiment of the wire 138", at least a plurality, preferably at least a plurality of pairs, of the filaments 145 and/or bristles 140 of the brush wire core 156 are twisted together forming at least a plurality, preferably at least a plurality of pairs, of twisted filament or twisted bristle strands which are in turn braided together forming a wire core 156 of twisted filament or twisted bristle braided strand construction.

As depicted in FIG. 10, the sleeve 164 is formed of elongate flat or generally rectangular cross-sectioned bands 166 each of which are helically wrapped around a core 156 of a brush wire 138" of the present invention in a plurality of different directions or orientations with the bands 166 braided together as shown in FIG. 10. In one preferred embodiment, each one of the bands 166 is of multifilament construction formed of at least a plurality, preferably at least a plurality of pairs, of relatively thin or fine filaments 168, which are each smaller in width or diameter than brush wire filaments 145 or bristles 140, which can in turn be braided or woven to form the band 166 with the sleeve 164 preferably being of braided multifilament construction. If desired, the outer brush wire core supporting sleeve 164 that holds the bristles 140 and/or filaments 145 of the brush wire core 156 together can also be of braided monofilament construction with each binding 154' or band 166 formed of a single elongate filament 170 with each such filament 170 being of circular or rectangular cross section having a width or diameter larger than filament(s) 168 but larger than bristles 140 or filaments 145. In another preferred embodiment, the sleeve 164 can be of a woven construction, such as a biaxial braided or biaxial woven construction formed of at least a plurality, preferably at least a plurality of pairs of filaments 168 biaxially braided or biaxially woven together to form tubular sleeve 164 that substantially completely encapsulates and coaxially telescopes over the bristles 140 and/or filaments 145 of the inner wire core 156.

Such a sleeve 164 preferably is an elongate generally cylindrical tube 172 of elongate, generally stiff but having some flex, and resilient brush wire core stiffening construction that substantially completely enshrouds or encapsulates all of the bristles 140 and/or filaments 145 of the core 156 of a brush wire 138" constructed in accordance with the present invention that forms a radial rotary wire brush, e.g., brush 85, which can be a wheel wire brush or a power brush, which possesses increased aggressiveness, a greater rate of material removal, and has a longer brush life than the brush of INVENTION 1 of Table 1. Such a sleeve 164 preferably generally coaxially covers substantially the length of at least the portion of the wire 138" or core 156 of the wire 138" that forms at least part of the tuft of the wire 138" or core 156 disposed at or adjacent the free end or face 144 of the core 156 formed by tips 142. In a preferred embodiment, sleeve 164 extends from at or adjacent the free end or face 144 of the core 156 toward and preferably to, at or adjacent where the core 156 of the wire 138" is attached or otherwise anchored to the hub 80 of a rotary radial brush, e.g., brush 85, made with such brush wires 138".

Such brush wire 138" of the invention having such a multifilament or multi-bristle abrasive brush wire core 156 generally coaxially and substantially completely enshrouded or encapsulated by elongate and tubular brush wire core stiffening and supporting sleeve 164 produces a rotary radial wire brush of the present invention that removes a greater amount of material more quickly and does so while having a longer brush life than the brush of invention 1 of Table 1. Such a brush wire 138" advantageously increases the aggressiveness and speed of the cut or area of the surface being finished or treated along which surface material is abrasively removed thereby during rotary brush operation. The resultant flexible twisted binding or twisted ribbon brush wire supporting sleeve 164 also helps dampen and/or absorb shock loads encountered by the bristles 140 or filaments 145 of the core 156 of wire 138" during abrasive material removal when contacting surfaces being treated or finished that are rougher, have upraised projections, or otherwise result in the wire 138" impacting thereagainst during brush rotation during abrasive material removal during surface finishing or treatment therewith. In doing so, the tips 142 of the bristles 140 of the core 156 of the wire 138" advantageously more continuously remain in contact with the surface being finished or treatment thereby producing a brush, e.g., brush 85, of the invention equipped with such wires 138" that abrasively remove a greater amount of surface material during a given amount of time or brush wire wear while advantageously producing a more uniform surface finish preferably while maintaining, if not extending, brush life. In addition, by the sleeve 164 providing support to the core filaments 145 or bristles 140 substantially along their length including to adjacent or at the tips 142 of the abrasive face 144, filament or bristle breakage is significantly reduced thereby increasing wire and brush life.

With additional reference to FIGS. 11 and 12, a rotary radial wire brush, e.g., brush 85, constructed in accordance with the present invention can and preferably is constructed with a pair of generally annular or circular cover plates 175 which are three dimensionally contoured or three dimensionally formed in a manner that increases the strength, torsional rigidity, torque handling ability, stiffness, reduces flexure or produces a rotary radial wire brush having one or more improved or beneficial characteristics. As shown in FIGS. 11 and 12, each one of the plates 175 that sandwich the hub 80 in forming a rotary radial brush assembly of the invention has a recessed generally planar annular hub center hub mounting well 176 with a brush mount 178 that can be in the form of an opening 180 such as a generally hexagonal arbor hole 182 for releasable mounting to a rotary power tool or the like such as by way of using a mounting nut arrangement, coupling assembly or the like. At least one and preferably both of the plates 175 have an upraised axially outwardly extending three dimensionally formed annular plate-stiffening hat or crown 184 extending radially outwardly of the centrally located hub mounting well 176 that preferably is circumferentially uninterrupted which also helps minimize and preferably substantially completely prevent wobble during brush rotation. As is best shown in FIG. 12, the hat or crown 184 includes an annular generally planar outer axial face 186 which carries labeling and other indicia, e.g., graphics, such as in the manner depicted in FIG. 11. Each plate 175 can have a generally planar annular flange 188 that extends radially outwardly of or from the hat or crown 184 that can and preferably does abut or seat against a corresponding one of the outer surfaces 88, 90 of the hub 80 when mounted or otherwise coupled thereto during brush assembly. Where each plate 175 is configured with such a radially outer annular flange 188, the flange 188 preferably is bounded by a radially outer peripheral edge 190 that extends completely about the periphery of each plate 175.

FIG. 13 illustrates a preferred embodiment of a rotary radial wire brush 85' constructed in accordance with the present invention that is equipped with standard twisted knot steel multifilament brush wires extending radially outwardly from a hub, e.g., hub 80, which is substantially completely covered by and sandwiched between a pair of outer cover plates 175" of the present invention each having a generally equiangularly spaced planar annular outer face 186 with a plurality of pairs, preferably at least four, upraised radially outwardly extending ribs 194 that each extend from at or adjacent the center of the plate and/or coupling nut assembly radially outwardly to or adjacent the outer periphery of the plate 175". FIG. 14 shows both cover plates 175' overlying one another with the hub and brush wires shown in FIG. 13 removed for clarity. As is depicted in FIG. 14, the cover plates 175' can be coupled to one another independently of the hub, but preferably each cover plate 175' is attached to an adjacent corresponding side of the hub which substantially completely covers such as by being fixed thereto.

In a preferred embodiment of the brush 85', the hub, e.g., hub 80, has 32 holes 96*a* and 96*b* which are of a radially offset configuration with an elongate brush wire radially outwardly extending from each hole 96*a* and 96*b* that has at least 30 bristles and/or filaments per wire. Where of twisted knot construction, each wire preferably has at least 30 bristles and at least 15 bristles where the bristles are folded over one another and twisted together during twist knot anchoring to the hub 80. If desired, such a brush 85' of the present invention can be equipped with any one or more of the brush wire 135', 135" and/or 135"' shown in FIGS. 8-10, including any brush wire variants and/or various embodiments thereof described above.

Each upraised radial rib 194 preferably is integrally formed in or of a generally circular metal blank used to form the plate 175' such as by stamping, forging or using another suitable material forming process in a manner that integrally forms all of the ribs 194 substantially simultaneously. Each rib 194 encompasses an angular extent of at least 3°, preferably at least 4°, and more preferably at least 5°, and has a widened or wider upraised base 196 disposed at or adjacent the center of the plate 175' or nut assembly 195 with an elongate radially extending upraised rib body 198 which preferably is defined by a pair of upraised elongate generally straight spaced apart radially extending rib sides 200, 202 which preferably uniformly and/or symmetrically converges or tapers to a narrowed or narrower generally squared rib end or tip or 204 producing a rib 194 that is integral with the plate 175' that helps to strengthen a brush 85" made with such a radial ribbed cover plate 175'. In the preferred embodiment shown in FIG. 13, each plate 175' has a plurality of pairs of the ribs 194 with a first pair of the ribs 194 disposed on opposite sides of the center of the plate 175' and inline with each other and a second pair of the ribs 194 is angularly offset relative to the first pair of the inline ribs 194 which also are disposed on opposite sides of the center of the plate 175'. As also depicted in FIG. 13, each one of the four ribs 194 is equiangularly spaced apart about 90° from every adjacent one of the four ribs 194 such that the ribs substantially uniformly strengthen the plate 175', hub 80 and brush 75'. Such a radial ribbed cover plate 175' strengthens at least the plate 175' and preferably also the hub 80 by helping minimize and preferably substantially completely prevent flexure of the plate 175' and/or the hub 80 during surface finishing using the brush 85" as shocks, vibration, and other forces encountered by the radially extending brush wires contacting the surface being finished are more efficiently transmitted radially inwardly via the ribs 194 to the stronger more rigid nut assembly 195 and/or tool spindle at the center of the brush 85". The nut assembly 195 not only has an internally threaded nut for removable mounting to a threaded rotary spindle or hub of a hand-held rotary brush drive, preferably a hand-held rotary power tool, e.g., grinder, angle grinder, die grinder, drill, etc., but the nut assembly 195 also is employed in fastening the outer cover plates 175' to the inner hub 80 sandwiching the hub 80 between the plates 175'.

FIG. 15 illustrates another preferred embodiment of a rotary radial wire brush 85" constructed in accordance with the present invention having standard twisted knot multifilament brush wires extending radially outwardly from a hub 80 which is substantially completely covered by and sandwiched between a pair of outer cover plates 175" of the present invention each having an stiffening and torsion rigidifying annulus 192 axially outwardly extending from the generally planar annular outer face 186 of the upraised axially extending annular hat or crown 184 of the plate 175". If desired, the cover plate 175" can be produced with a plurality of the upraised cover strengthening annulus 192, each generally coaxial with one another and having different diameters. In the brush 85" of FIG. 15, the outer peripheral edge 190" of each cover plate 175" is axially downturned facing generally toward the corresponding outer surface 88, 90 of the inner hub 80 covered by the plate 175". In the embodiment shown in FIG. 14, the downturned peripheral edge 190" of each cover plate 175" is disposed adjacent corresponding hub surface 88, 90 overlying the root portion of each radially extending brush wire and can seat on or against one or more of the wire root and/or hub surface 88, 90 such as by contacting, abutting or bearing against one or both in the manner depicted in FIG. 15. The root portion of each brush wire is that portion of the wire extending from the hole 96*a* and/or 96*b* in which the brush is anchored. Such a brush 85" can also employ any one or more of the brush wire 135', 135" and/or 135"' shown in FIGS. 8-10 as well as any variants and/or embodiments thereof described above.

The present invention is directed to a rotary brush that includes (a) a central disc hub with at least a plurality of pair of brush wire mounts spaced (i) radially from a central axis of rotation of the brush, and (ii) circumferentially apart from one another, and (b) at least a plurality of pairs of brush wire filament bundles carried by the brush wire mounts for rotation in unison with the central disc hub, each one of the brush wire filament bundles extending outwardly from a corresponding one of the brush wire mounts of the central disc hub radially beyond an outer peripheral edge of the central disc hub, and each one of the brush wire filament bundles having free end(s) or tip(s) disposed radially outwardly of the outer peripheral edge of the central disc hub forming an abrasive face thereof that abrasively removes material from a surface to be finished during contact therewith during rotation of the central disc hub rotation of the rotary brush by a hand-held rotary power tool.

The central disc hub of such a rotary brush has brush wire mounts, preferably in the form of through-bores, spaced circumferentially about the central disc hub and arranged in an alternating radially offset brush wire mount configuration wherein a first plurality of the brush wire mounts are circumferentially spaced apart a first radial distance from a center or central axis of the central disc hub, a second plurality of the brush wire mounts are circumferentially spaced apart a second radial distance from the center or central axis of the central disc hub, and wherein the brush wire mounts of the first and second plurality of pairs alternate circumferentially about the central disc hub. Each brush wire extends radially outwardly from a corresponding one of the brush mounts with each brush wire being elongate and formed of a brush wire filament bundle having between twenty-two and thirty-four brush bristles or brush wire bristles. Each one of the brush bristles or brush wire bristles preferably is formed of a brush wire filament and/or a brush wire filament strand. Each brush wire is anchored to a brush wire mount via a twisted knot where the brush wire is arranged into a twisted knot that fixes the brush wire to the central disc hub.

In a preferred embodiment, each brush wire is formed of between twenty-eight and thirty-four bristles with each brush bristle formed of one of a brush wire filament and brush wire filament strand. In another preferred embodiment, each brush wire is formed of between twenty-nine and thirty-three bristles with each brush bristle formed of one of a brush wire filament and brush wire filament strand. In still another preferred embodiment, each brush wire is formed of between thirty and thirty-two bristles with each brush bristle formed of one of a brush wire filament and brush wire filament strand. In a further preferred embodiment, each brush wire is formed of about thirty-two bristles with each brush bristle formed of one of a brush wire filament and brush wire filament strand. Such wire brush filaments and/or wire brush filament strands are composed of Tampico, nylon, or polypropylene, nonferrous filaments and/or strands, such as filaments and/or strands made of brass or bronze, e.g., phosphorous bronze, ferrous filaments and/or strands such as a medium or high-carbon steel, e.g., heat-treated, high tensile strength high-carbon or high drawn steel wire filaments and/or strands, and stainless steel, e.g., Type 302 stainless steel, Type 304 stainless steel or Type 316 stainless steel, and coated or encapsulated filaments and/or strands, such as elastomer or plastic coated metallic wire filaments and/or strands, whose choice typically depends on the particular abrasive material removal or surface finishing application for which the brush is intended to be used.

Each brush wire mount preferably is or includes an aperture or opening, e.g., through-opening, formed in the central disc hub. In a preferred embodiment, each aperture or opening of each brush mount is circular or oblong with each aperture or opening of the radially outermost set or group of brush mounts being larger in size, width or diameter than each aperture or opening of the radially innermost set or group of brush mounts. In a preferred embodiment, the apertures or openings of the radially outermost group or set of uniformly circumferentially spaced apart brush mounts are circular and larger in size, e.g., larger in diameter, than the circular apertures or circular openings of the radially innermost group or set of uniformly circumferentially spaced apart brush mounts.

Each brush wire is anchored to a brush wire mount of the center disc hub via a twisted knot where the brush wire is arranged into a twisted knot that fixes the brush wire to the central disc hub. In one preferred embodiment, each brush wire extends radially from a corresponding aperture or opening of a respective brush mount and is anchored thereto by a twisted knot having a relatively tight twist that produces a tuft and/or working face at or adjacent the free or working end of the brush wire that has a width or diameter substantially the same as the filaments or strands that form the wire when the filaments and/or strands are in a straightened condition and disposed in contact along a lengthwise direction thereof. In one such preferred embodiment, each brush wire is anchored to the disc hub by a cable knot, cable twist knot or cable twisted knot. In another such preferred embodiment, each brush wire is anchored to the disc hub by a stringer knot, stringer twist knot or stringer twisted knot.

In one preferred brush wire embodiment, each brush wire of an abrasive rotary brush of the present invention is formed of a brush wire filament bundle that includes an elongate radially extending cable-twisted bead brush wire and/or a segment or section of such cable-twisted bead brush wire. In another preferred embodiment, each brush wire is formed of a brush wire filament bundle that includes an elongate axially extending cable-twisted bead brush wire and/or a segment or section of such cable-twisted bead brush wire.

In one preferred embodiment, each brush wire has an inner core formed of at least a plurality, preferably a plurality of pairs, of brush wire filaments twisted together at least a plurality of times along the length of the core and/or brush wire. In another preferred embodiment, each brush wire has an inner core formed of at least a plurality, preferably a plurality of pairs, of brush wire filaments twisted together at least a plurality of pairs of times along the length of the core and/or brush wire. In still another preferred embodiment, each brush wire has an inner core formed of at least a plurality, preferably a plurality of pairs, of brush wire filaments braided together along the length of the core and/or brush wire. In yet another preferred embodiment, each brush wire has an inner core formed of at least a plurality, preferably a plurality of pairs, of brush wire filaments braided and twisted together along the length of the core and/or brush wire. In a further preferred embodiment, each brush wire has an inner core formed of at least a plurality, preferably a plurality of pairs, of brush wire filaments braided and twisted together along the length of the core and/or brush wire with the filaments twisted together at least a plurality of times along the length of the core and/or wire. In yet another preferred embodiment, each brush wire has an inner core formed of at least a plurality, preferably a plurality of pairs, of brush wire filaments woven together along the length of the core and/or brush wire. In a still further preferred embodiment, each brush wire has an inner core formed of at least a plurality, preferably a plurality of pairs, of brush wire filaments woven and twisted together along the length of the core and/or brush wire with the filaments twisted together at least a plurality of times along the length of the core and/or wire. If desired, one or more of the filaments of the inner core can be formed of a plurality of thinner or narrower filament strands which are in turn twisted, braided and/or woven to form the filament(s).

In a further preferred embodiment, each brush wire is a hybrid twisted braided brush wire that includes an outer plurality of pairs, i.e., at least three, brush wire filaments and/or brush wire filament strands wrapped, twisted, braided or otherwise woven about or around an inner brush wire core formed of at least a plurality of pairs of brush wire filaments and/or brush wire filament strands. In one such further preferred embodiment, the outer plurality of pairs of brush wire filaments and/or brush wire filament strands form a sheath, latticework or sleeve about or around the inner brush wire core. In another such further preferred embodiment, the outer plurality of pairs of brush wire filaments and/or brush wire filament strands form a sheath, latticework or sleeve that is tubular about or around the inner brush wire core. Such a sheath, latticework or sleeve helps structurally support and strengthen the filaments and/or strands of the inner brush core helping the brush wire remove a greater amount of abrasive material for a longer period of time thereby improving brush performance and extending brush life.

In one preferred embodiment, each brush wire is formed of at least a plurality, preferably a plurality of pairs, of brush wire filaments twisted together at least a plurality of times along the length of the core and/or brush wire. In another preferred embodiment, each brush wire is formed of at least a plurality, preferably a plurality of pairs, of brush wire filaments twisted together at least a plurality of pairs of times along the length of the brush wire. In still another preferred embodiment, each brush wire is formed of at least a plurality, preferably a plurality of pairs, of brush wire filaments braided together along the length of the brush wire. In yet another preferred embodiment, each brush wire is formed of at least a plurality, preferably a plurality of pairs, of brush wire filaments braided and twisted together along the length of the brush wire. In a further preferred embodiment, each brush wire is formed of at least a plurality, preferably a plurality of pairs, of brush wire filaments braided and twisted together along the length of the brush wire with the filaments twisted together at least a plurality of times along the length of the wire. In yet another preferred embodiment, each brush wire is formed of at least a plurality, preferably a plurality of pairs, of brush wire filaments woven together along the length of the brush wire. In a still further preferred embodiment, each brush wire is formed of at least a plurality, preferably a plurality of pairs, of brush wire filaments woven and twisted together along the length of the brush wire with the filaments twisted together at least a plurality of times along the length of the wire. If desired, one or more of the filaments of the brush wire can be formed of a plurality of thinner or narrower filament strands which are in turn twisted, braided and/or woven to form the filament(s).

In a preferred embodiment, each brush is formed of at least a plurality of elongate brush bristles in the form of one of an elongate brush wire filament and thinner or narrower elongate brush wire filament strand twisted together at least a plurality of times along the length of the brush wire. In another preferred embodiment, each brush is formed of at least a plurality of pairs, i.e., at least three, elongate brush bristles with each brush bristle being in the form of one of an elongate brush wire filament and thinner or narrower elongate brush wire filament strand with the brush bristles twisted together at least a plurality of times along the length of the brush wire. In another preferred embodiment, each brush is formed of at least a plurality of pairs, i.e., at least three, elongate brush bristles with each brush bristle being in the form of one of an elongate brush wire filament and thinner or narrower elongate brush wire filament strand with the brush bristles twisted together at least a plurality of pairs of times along the length of the brush wire. In a preferred embodiment, where equipped with such a sheath, latticework or sleeve, the sheath, latticework or sleeve can telescope over the filaments and/or strands of the inner core of each brush wire.

The rotary brush has at least one cover plate and preferably a pair of cover plates covering the center disc hub with at least one of the cover plates having a plurality of radially outwardly extending upraised ribs formed therein that strengthen and/or structurally rigidify the brush. Each one cover plates are carried by the hub and has (a) a first pair of the upraised ribs formed therein extending radially oppositely outwardly on opposite sides of a center or central opening of the plate with the ribs of the first pair generally aligned with one another, and (b) a second pair of the upraised ribs formed therein extending radially oppositely outwardly on opposite sides of a center or central opening of the plate with the ribs of the second pair generally aligned with one another. In at least one such preferred embodiment, a pair of the cover plates sandwiches the hub therebetween.

In another preferred embodiment, a rotary abrasive brush of the present invention has at least one cover plate carried by the hub, the at least one cover plate having an upraised circular ridge radially disposed between a center or center opening of the plate, and an outer periphery of the plate. In one such preferred embodiment, the hub carries a pair of cover plates that each has an upraised circular ridge radially disposed between a center or center opening of the plate, and an outer periphery of the plate. In at least one such preferred embodiment, a pair of the cover plates sandwiches the hub therebetween.

A rotary radial wire brush made of an annular center disc hub having 32 holes arranged in two circles along the center disc hub where the holes are circumferentially spaced apart two different radial distances, e.g., radially offset, from a center of the disc hub about which the brush rotates with each hole having an abrasive brush anchored thereto that is formed of a brush wire bundle having at least 22 and no more than 34 brush wire filaments and/or brush wire filament strands. In a preferred embodiment, the annular center disc hub has 32 holes to which a brush is anchored to or in each by a knot with each brush formed of between 22 and 32 brush wire filaments and/or brush wire filament strands tightly twisted and/or braided together in forming such a brush wire of the present invention with a tuft and working face at the free or working end of the brush that is substantially the same as the width or diameter of the filaments and/or strands disposed alongside one another in contact with one another. In such a preferred embodiment, the holes of a radially outermost group or set of the holes are larger in size than the holes of a radially innermost group or set of holes enabling the brush wires anchored to the radially outermost group or set of holes to be more tightly twisted and/or braided than the brush wires anchored to the radially innermost group or set of holes. In addition, the brush wires anchored by knots to the radially outermost group or set of holes have a length that positions their working face disposed at their free or working end radially outwardly beyond the working face of each one of the brushes anchored to the radially innermost group or set of holes.

Each brush can be composed of a brush wire bundle formed of an inner core of brush wire filaments or brush wire filament strands twisted together which can be covered or enshrouded by an outer sheath in the form of an open twisted, braided or woven latticework or tubular sleeve that extends substantially the length of the brush wire. If desired, such an outer sheath or outer tubular sleeve of the brush wire can be formed of filament strands braided and/or woven together and/or around the inner core of each brush wire. If desired, such filament strands of the outer sheath or outer tubular sleeve can be of a different diameter, material, toughness, hardness, abrasiveness, composition or heat treatment than the brush wire filaments and brush wire filament strands that form the inner brush wire core.

In one such preferred brush wire construction, the inner core of at least a plurality of the brush wires, preferably all of the brush wires, is formed by twisting all of the brush wire filaments of the core. In another such preferred brush wire construction, the inner core is formed by twisting at least a plurality, preferably at least a plurality of pairs, of brush wire filament strands together to form elongate brush wire filaments. The brush wire filaments can in turn be twisted together, braided together and/or woven together to form the inner core of the brush wire and/or to form the brush wire.

In still another such preferred brush wire bundle, the inner core is formed by braiding at least a plurality, preferably at least a plurality of pairs, of brush wire filament strands into elongate braided wire filaments. The braided wire filaments in turn are then twisted together, braided together, and/or woven together to form the inner brush wire core and/or to form the brush wire. In a further such preferred brush wire bundle, the inner core is formed by weaving at least a plurality, preferably at least a plurality of pairs, of strands into elongate woven wire filaments. The woven wire filaments can in turn be twisted together, braided together and/or woven together to form the brush wire or an inner core of the brush wire.

A rotary radial brush of the present invention can be formed of a pair of outer cover plates between which the hub is disposed with each cover plate having at least a plurality of pairs of upraised strengthening ribs formed therein with one pair of the ribs spaced apart and disposed on opposite sides of a center or central opening in the plate and which are also aligned within one another and another one pair of the ribs also spaced apart and disposed on opposite sides of the center or central opening in the plate and which are also aligned within one another. Each aligned pair of the ribs are equiangularly spaced apart relative to one another with a preferred cover plate having one of the pairs of aligned ribs generally perpendicularly oriented relative to the other one of the pairs of aligned ribs by an angle of about 90°±5°.

Understandably, the present invention has been described above in terms of one or more preferred embodiments and methods. It is recognized that various alternatives and modifications can be made to these embodiments and methods that are within the scope of the present invention. It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

The invention claimed is:

1. A rotary brush comprising:

(a) a central disc hub with multiple pairs of brush wire mounts spaced (i) radially from a central axis of rotation of the brush, and (ii) circumferentially apart from one another;

(b) an elongate brush wire carried by each brush wire mount, each brush wire extending radially outwardly from the brush wire mount beyond an outer radial periphery of the central disc hub defining a working face at or adjacent a free end thereof that abrasively contacts a surface during rotation of the rotary brush;

wherein the central disc hub has a radially outermost group of brush mounts spaced circumferentially about the hub, and wherein the central disc hub has a radially innermost group of brush mounts spaced circumferentially about the hub that is spaced radially inwardly of the radially outermost group of brush mounts; and wherein at least one of the following applies: (iii) the brush wires extending radially outwardly from the radially outermost brush mounts have a working face disposed radially outwardly of the working face of the brush wires extending radially outwardly from the radially innermost brush mounts, and (iv) the brush wires extending radially outwardly from the radially outermost brush mounts extend farther radially outwardly than the brush wires extending radially outwardly from the radially innermost brush mounts.

2. The rotary brush of claim 1, wherein condition (iv) applies and wherein each one of the brush wires is comprised of a plurality of elongate brush wire filaments twisted together a plurality of times along the length of the brush wire.

3. The rotary brush of claim 1, wherein condition (iv) applies and wherein each one of the brush wires is comprised of between twenty-two and thirty-four brush wire filaments twisted together along the length of the brush wire.

4. The rotary brush of claim 1, wherein condition (iv) applies and wherein each one of the brush wires is comprised of multiple pairs of wire filaments braided together along the length of the brush wire.

5. The rotary brush of claim 1, wherein condition (iv) applies and wherein each one of the brush wires is comprised of between twenty-two and thirty-four brush wire filaments braided together along the length of the brush wire.

6. The rotary brush of claim 1, wherein condition (iv) applies and wherein each one of the brush wires is comprised of multiple pairs of wire filaments twisted and braided together along the length of the brush wire.

7. The rotary brush of claim 1, wherein condition (iv) applies and wherein each one of the brush wires is comprised of between twenty-two and thirty-four brush wire filaments twisted and braided together along the length of the brush wire.

8. A rotary brush comprising:

(a) a central disc hub with multiple pairs of brush wire mounts spaced (i) radially from a central axis of rotation of the brush, and (ii) circumferentially apart from one another;

(b) an elongate brush wire carried by each brush wire mount, each brush wire extending radially outwardly from the brush wire mount beyond an outer radial periphery of the central disc hub defining a working face at or adjacent a free end thereof that abrasively contacts a surface during rotation of the rotary brush;

wherein the central disc hub has (a) a radially outermost group of brush mounts spaced circumferentially about the hub, and (b) a radially innermost group of brush mounts spaced circumferentially about the hub that is spaced radially inwardly of the radially outermost group of brush mounts; and wherein the radially outermost brush mounts are circumferentially staggered between the radially innermost brush mounts, and wherein each one of the brush wires extending outwardly from each one of the brush mounts has the same length thereby disposing the working face of the brush wires extending radially outwardly from the radially outermost brush mounts radially outwardly of the working face of the brush wires extending radially outwardly from the radially innermost brush mounts.

9. The rotary brush of claim 8, wherein each one of the brush wires is comprised of a plurality of elongate brush wire filaments twisted together a plurality of times along the length of the brush wire.

10. The rotary brush of claim 9, wherein each one of the brush wire filaments is comprised of a plurality of brush wire filament strands of a width, diameter, or thickness less than the filament where the brush wire filament strands are twisted, braided or woven to form the filament.

11. The rotary brush of claim 9, wherein each one of the brush wires is comprised of between twenty-two and thirty-four brush wire filaments twisted together along substantially the entire length of the brush wire.

12. The rotary brush of claim 8, wherein each one of the brush wires is comprised of multiple pairs of wire filaments braided together along the length of the brush wire.

13. The rotary brush of claim 12, wherein each one of the brush wire filaments is comprised of a plurality of brush wire filament strands of a width, diameter, or thickness less than the filament where the brush wire filament strands are twisted, braided or woven to form the filament.

14. The rotary brush of claim 13, wherein each one of the brush wires is comprised of between twenty-two and thirty-four brush wire filaments braided together along substantially the entire length of the brush wire.

15. The rotary brush of claim 8, wherein each one of the brush wires is comprised of multiple pairs of wire filaments twisted and braided together along the length of the brush wire.

16. The rotary brush of claim 15, wherein each one of the brush wire filaments is comprised of a plurality of brush wire filament strands of a width, diameter, or thickness less than the filament where the brush wire filament strands are twisted, braided or woven to form the filament.

17. The rotary brush of claim 16, wherein each one of the brush wires is comprised of between twenty-two and thirty-four brush wire filaments twisted and braided together along substantially the entire length of the brush wire.

18. A rotary brush comprising:

(a) a central disc hub with multiple pairs of brush wire mounts spaced (i) radially from a central axis of rotation of the brush, and (ii) circumferentially apart from one another;

(b) an elongate brush wire carried by each brush wire mount, each brush wire extending radially outwardly from the brush wire mount beyond an outer radial periphery of the central disc hub defining a working face at or adjacent a free end thereof that abrasively contacts a surface during rotation of the rotary brush;

wherein the central disc hub has (a) a radially outermost group of brush mounts spaced circumferentially about the hub, and (b) a radially innermost group of brush mounts spaced circumferentially about the hub that is spaced radially inwardly of the radially outermost group of brush mounts; and wherein the radially outermost brush mounts are circumferentially staggered between the radially innermost brush mounts, and wherein each one of the radially innermost and radially outermost brush mounts comprises an opening, wherein openings of the radially outermost brush mounts are larger than the openings of the radially innermost brush mounts.

19. The rotary brush of claim 18, wherein each one of the brush wires is comprised of a plurality of brush wire filaments twisted or braided together and a twisted knot anchoring the brush wire to a corresponding one of the brush wire mounts, and wherein the brush wire has a brush face of a width or diameter substantially the same as the width or diameter of the plurality of brush wire filaments extending alongside and in contact with one another when disposed in a substantially straightened condition.

20. The rotary brush of claim 19, wherein each one of the brush wires is comprised of a cable knot anchoring the brush wire to a corresponding one of the brush wire mounts.

21. The rotary brush of claim 19, wherein each one of the brush wires is comprised of a stringer bead knot anchoring the brush wire to a corresponding one of the brush wire mounts.

22. The rotary brush of claim 18, wherein each one of the brush wires is comprised of a plurality of brush wire filaments twisted or braided together and a twisted knot anchoring the brush wire to a corresponding one of the brush wire mounts, and wherein the brush wire has a tuft and a brush face of a width or diameter substantially the same as the width or diameter of the plurality of brush wire filaments extending alongside and in contact with one another when disposed in a substantially straightened condition.

23. The rotary brush of claim 22, wherein each one of the brush wires is comprised of a cable knot anchoring the brush wire to a corresponding one of the brush wire mounts.

24. The rotary brush of claim 22, wherein each one of the brush wires is comprised of a stringer bead knot anchoring the brush wire to a corresponding one of the brush wire mounts.

* * * * *